US010410572B2

(12) United States Patent
Yu et al.

(10) Patent No.: US 10,410,572 B2
(45) Date of Patent: Sep. 10, 2019

(54) DISPLAY DEVICE INCLUDING TIMING CONTROLLER

(71) Applicant: SAMSUNG ELECTRONICS CO., LTD., Suwon-si (KR)

(72) Inventors: Yong Hoon Yu, Suwon-si (KR); Taehyun Kim, Suwon-si (KR); Byoungyoon Jang, Gimhae-si (KR); JaeYoul Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/004,926

(22) Filed: Jun. 11, 2018

(65) Prior Publication Data

US 2019/0156728 A1 May 23, 2019

(30) Foreign Application Priority Data

Nov. 22, 2017 (KR) ..... 10-2017-0156262

(51) Int. Cl.
*G09G 3/20* (2006.01)

(52) U.S. Cl.
CPC ... *G09G 3/2092* (2013.01); *G09G 2310/0267* (2013.01); *G09G 2310/0275* (2013.01); *G09G 2310/08* (2013.01); *G09G 2320/029* (2013.01); *G09G 2320/0252* (2013.01); *G09G 2330/028* (2013.01)

(58) Field of Classification Search
CPC ..... G09G 3/2092; G09G 2310/08; G09G 2310/0267; G09G 2330/028; G09G 2320/029; G09G 2310/0275; G09G 2320/0252
See application file for complete search history.

(56) References Cited

U.S. PATENT DOCUMENTS

| | | | | |
|---|---|---|---|---|
| 7,466,310 | B2 | 12/2008 | Yang et al. | |
| 8,907,992 | B2 | 12/2014 | Yang et al. | |
| 9,020,998 | B2 | 4/2015 | Longhurst | |
| 9,390,663 | B2 | 7/2016 | Schutten et al. | |
| 2003/0006949 | A1* | 1/2003 | Sekiya ..... | G09G 3/2011 345/87 |
| 2006/0125748 | A1 | 6/2006 | Yang et al. | |
| 2007/0046602 | A1 | 3/2007 | You et al. | |
| 2007/0222707 | A1 | 9/2007 | Thebault et al. | |

(Continued)

FOREIGN PATENT DOCUMENTS

WO 96/39774 A1 12/1996

*Primary Examiner* — Shaheda A Abdin
(74) *Attorney, Agent, or Firm* — Sughrue Mion, PLLC

(57) ABSTRACT

A display device is provided. The display device may include pixels arranged in rows and columns, gate drivers connected to the rows of the pixels through gate lines, source drivers connected to the columns of the pixels through source lines, and a timing controller configured to control the gate drivers and the source drivers. The source driver associated with the specific pixel among the source drives may first supply an overdrive voltage corresponding to a final overdrive value to a source line connected to the specific pixel and then supply a source line voltage corresponding to a current value of the specific pixel to the source line. The overdrive controller may change weight values of at least two overdrive values based on a position of the specific pixel and interpolate the at least two overdrive values.

20 Claims, 18 Drawing Sheets

(56) References Cited

U.S. PATENT DOCUMENTS

| | | | | |
|---|---|---|---|---|
| 2009/0091588 | A1 | 4/2009 | Chen et al. | |
| 2011/0193610 | A1 | 8/2011 | Longhurst | |
| 2012/0056908 | A1 | 3/2012 | Yang et al. | |
| 2012/0188166 | A1* | 7/2012 | Nurmi ..... | G09G 3/3648 345/168 |
| 2015/0213770 | A1 | 7/2015 | Baek | |
| 2015/0228055 | A1 | 8/2015 | Schutten et al. | |
| 2016/0180761 | A1 | 6/2016 | Sasaki | |

* cited by examiner

FIG. 4

| CV \ PV | 0 | 16 | 32 | 48 | 64 | 80 | 96 | 112 | 128 | 144 | 160 | 176 | 192 | 208 | 224 | 255 |
|---|---|---|---|---|---|---|---|---|---|---|---|---|---|---|---|---|
| 0 | A1 | A2 | A3 | A4 | A5 | A6 | A7 | A8 | A9 | A10 | A11 | A12 | A13 | A14 | A15 | A16 |
| 16 | B1 | B2 | B3 | B4 | B5 | B6 | B7 | B8 | B9 | B10 | B11 | B12 | B13 | B14 | B15 | B16 |
| 32 | C1 | C2 | C3 | C4 | C5 | C6 | C7 | C8 | C9 | C10 | C11 | C12 | C13 | C14 | C15 | C16 |
| 48 | D1 | D2 | D3 | D4 | D5 | D6 | D7 | D8 | D9 | D10 | D11 | D12 | D13 | D14 | D15 | D16 |
| 64 | E1 | E2 | E3 | E4 | E5 | E6 | E7 | E8 | E9 | E10 | E11 | E12 | E13 | E14 | E15 | E16 |
| 80 | F1 | F2 | F3 | F4 | F5 | F6 | F7 | F8 | F9 | F10 | F11 | F12 | F13 | F14 | F15 | F16 |
| 96 | G1 | G2 | G3 | G4 | G5 | G6 | G7 | G8 | G9 | G10 | G11 | G12 | G13 | G14 | G15 | G16 |
| 112 | H1 | H2 | H3 | H4 | H5 | H6 | H7 | H8 | H9 | H10 | H11 | H12 | H13 | H14 | H15 | H16 |
| 128 | I1 | I2 | I3 | I4 | I5 | I6 | I7 | I8 | I9 | I10 | I11 | I12 | I13 | I14 | I15 | I16 |
| 144 | J1 | J2 | J3 | J4 | J5 | J6 | J7 | J8 | J9 | J10 | J11 | J12 | J13 | J14 | J15 | J16 |
| 160 | K1 | K2 | K3 | K4 | K5 | K6 | K7 | K8 | K9 | K10 | K11 | K12 | K13 | K14 | K15 | K16 |
| 176 | L1 | L2 | L3 | L4 | L5 | L6 | L7 | L8 | L9 | L10 | L11 | L12 | L13 | L14 | L15 | L16 |
| 192 | M1 | M2 | M3 | M4 | M5 | M6 | M7 | M8 | M9 | M10 | M11 | M12 | M13 | M14 | M15 | M16 |
| 208 | N1 | N2 | N3 | N4 | N5 | N6 | N7 | N8 | N9 | N10 | N11 | N12 | N13 | N14 | N15 | N16 |
| 224 | O1 | O2 | O3 | O4 | O5 | O6 | O7 | O8 | O9 | O10 | O11 | O12 | O13 | O14 | O15 | O16 |
| 255 | P1 | P2 | P3 | P4 | P5 | P6 | P7 | P8 | P9 | P10 | P11 | P12 | P13 | P14 | P15 | P16 |

DISPLAY DEVICE INCLUDING TIMING CONTROLLER

CROSS-REFERENCE TO RELATED APPLICATION

This application claims priority from Korean Patent Application No. 10-2017-0156262, filed on Nov. 22, 2017 in the Korean Intellectual Property Office, the disclosure of which is incorporated herein in its entirety by reference.

BACKGROUND

1. Field

Apparatuses and methods consistent with example embodiments relate to a display device, and more particularly to a display device including a timing controller.

2. Description of the Related Art

A display device may display image data in the form visible to a user. The display device may include pixels, each of which has a specific color and luminance which may be adjusted according to image data. The pixels may be arranged in rows and columns. The display device may provide consecutive images to the user by sequentially adjusting luminance of pixels in units of one or more rows or columns.

As the display device increases in resolution, pixels included in the display device increase in number. As the pixels of the display device increase in number, a resistance component or a capacitance component formed by the pixels may increase. If the resistance component or the capacitance component increases, when voltage is supplied to pixels, a change in voltages of the pixels may have greater latency. In other words, the pixels may deteriorate in response. The enlargement of the display device may further exacerbate such a phenomenon.

SUMMARY

Example embodiments of the present disclosure provide a display device for enhancing response of pixels, increasing or maintaining quality of an image, and saving power consumption.

According to an aspect of an example embodiment, a display device may include pixels arranged in rows and columns, gate drivers connected to the rows of the pixels through gate lines, source drivers connected to the columns of the pixels through source lines, and a timing controller configured to control the gate drivers and the source drivers. The timing controller may include an overdrive controller configured to store look-up tables (LUTs) including candidate overdrive values according to previous values and current values with respect to reference pixels among the pixels, generate overdrive values associated with a previous value and a current value of a specific pixel from specific LUTs associated with the specific pixel of a selected row among the pixels among the LUTs, and output a final overdrive value of the specific pixel by interpolating the overdrive values. A source driver associated with the specific pixel among the source drivers may supply an overdrive voltage corresponding to the final overdrive value to a source line connected to the specific pixel and supply a source line voltage corresponding to the current value of the specific pixel to the source line. The overdrive controller may be configured to adjust weight values of at least two of the overdrive values based on a position of the specific pixel and interpolate the at least two of the overdrive values using the weight values.

According to an aspect of an example embodiment, a display device may include pixels arranged in rows and columns, gate drivers connected to the rows of the pixels through gate lines, source drivers connected to the columns of the pixels through source lines, and a timing controller configured to control the gate drivers and the source drivers. The timing controller may include an address generator configured to receive a previous value and a current value of a specific pixel and generate an address based on the previous value and the current value, a cache memory configured to receive the address, output one of first candidate overdrive values and second candidate overdrive values in response to one of the first candidate overdrive values and the second candidate overdrive values corresponding to the address being stored, and output the address in response to one of the first candidate overdrive values and the second candidate overdrive values being not stored, a memory configured to store LUTs and transmit one of the first candidate overdrive values and the second candidate overdrive values associated with the address from the LUTs to the cache memory in response to the address being received from the cache memory, a first interpolator configured to output a first overdrive value by interpolating the first candidate overdrive values and output a second overdrive value by interpolating the second candidate overdrive values, and a second interpolator configured to output a final overdrive value by interpolating the first overdrive value and the second overdrive value. Each of the source drivers may supply an overdrive voltage corresponding to the final overdrive value to a source line connected to the specific pixel and may supply a source line voltage corresponding to the current value of the specific pixel to the source line.

According to an aspect of an example embodiment, a display device may include pixels arranged in rows and columns, gate drivers connected to the rows of the pixels through gate lines, source drivers connected to the columns of the pixels through source lines, and a timing controller configured to control the gate drivers and the source drivers. The timing controller may include an overdrive controller configured to store LUTs including candidate overdrive values according to previous values and current values with respect to reference pixels among the pixels, generate overdrive values associated with a previous value and a current value of a specific pixel from specific LUTs associated with the specific pixel of a selected row among the pixels among the LUTs, and output a final overdrive value of the specific pixel by interpolating the overdrive values. A source driver associated with the specific pixel among the source drivers may supply an overdrive voltage corresponding to the final overdrive value to a source line connected to the specific pixel and may supply a source line voltage corresponding to the current value of the specific pixel to the source line. The overdrive controller may be configured to select the current value as the final overdrive value in response to a difference between the previous value and the current value of the specific pixel being less than a threshold value.

According to an aspect of an example embodiment, a display device may include pixels arranged in rows and columns, gate drivers connected to the rows of the pixels through gate lines, source drivers connected to the columns of the pixels through source lines, and a timing controller configured to control the gate drivers and the source drivers. The timing controller may include an overdrive controller configured to store look-up tables (LUTs) including candidate overdrive values according to previous values and current values with respect to reference pixels among the pixels, generate overdrive values associated with a previous value and a current value of a specific pixel from specific LUTs associated with the specific pixel of a selected row among the pixels among the LUTs, and output a final overdrive value of the specific pixel by interpolating the overdrive values. The source driver associated with the specific pixel among the source drivers may supply an overdrive voltage corresponding to the final overdrive value to a source line connected to the specific pixel and supply a source line voltage corresponding to the current value of the specific pixel to the source line. The overdrive controller may be configured to read candidate overdrive values from one of the specific LUTs associated with the specific pixel using the previous value and the current value of the specific pixel, adjust weight values of the candidate overdrive values depending on a range to which the previous value or the current value belongs, and generate one of the overdrive values by interpolating the candidate overdrive values.

BRIEF DESCRIPTION OF THE FIGURES

The above and/or other objects and features will become apparent from the following description with reference to the following figures, wherein like reference numerals refer to like parts throughout the various figures unless otherwise specified, and wherein:

FIG. 4 is a drawing illustrating an example of an LUT associated with one reference pixel;

DETAILED DESCRIPTION

Hereinafter, example embodiments are described for clarity and in detail so that this disclosure will be thorough and complete and will fully convey the scope of the inventive concept to those skilled in the art.

Figure 1:
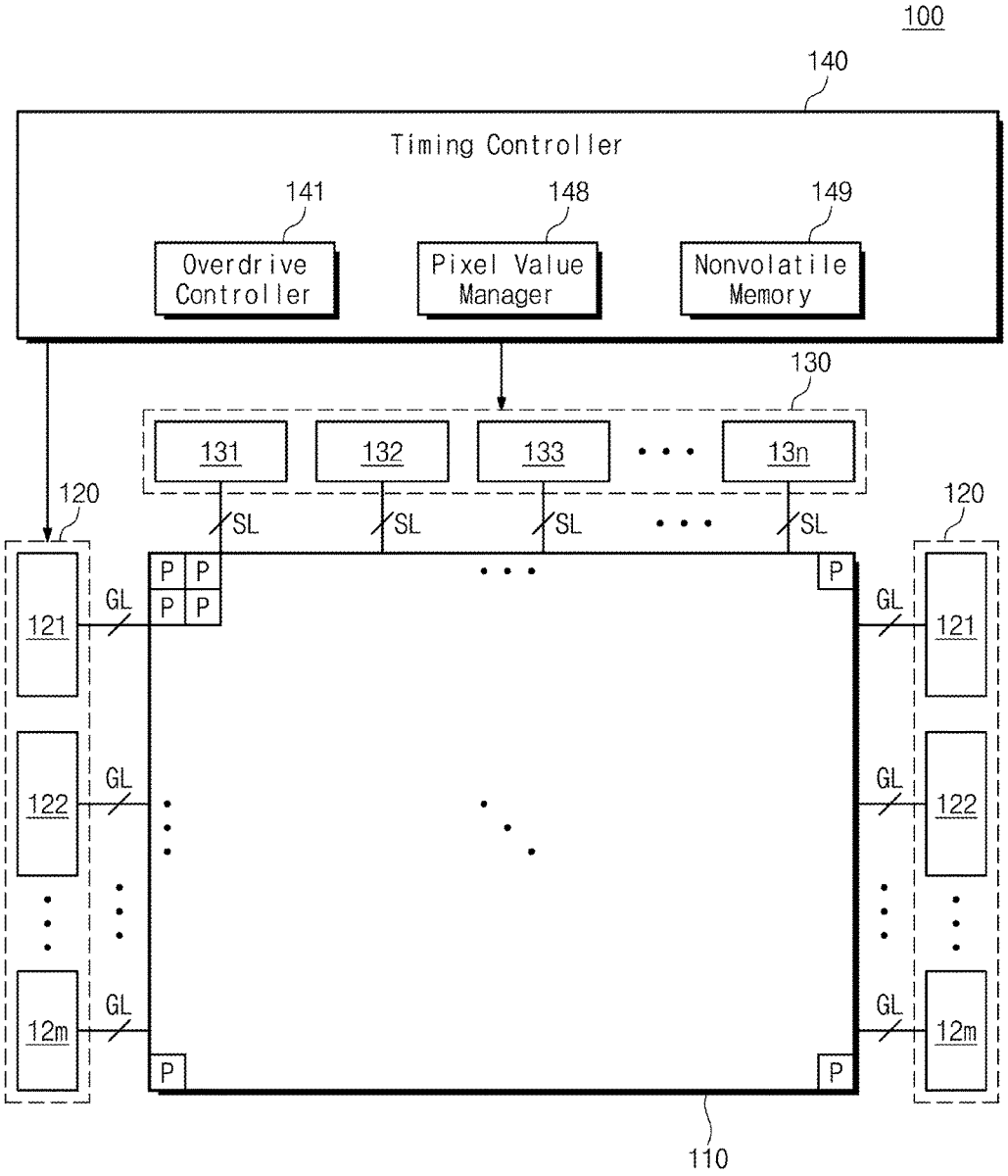
FIG. 1 is a block diagram illustrating a configuration of a display device according to an example embodiment.

FIG. 1 is a block diagram illustrating a configuration of a display device 100 according to an example embodiment. Referring to FIG. 1, the display device 100 may include a display panel 110, a gate driver unit 120, a source driver unit 130, and a timing controller 140. The display panel 110 may include pixels P.

The pixels P may be arranged in rows and columns. Each of the pixels P may correspond to one of red, green, and blue. Each of the pixels P may include a color filter having a corresponding color. The rows of the pixels P may be connected to gate lines GL. The columns of the pixels P may be connected to source lines SL.

The gate driver unit 120 may include gate drivers 121 to 12*m*. Each of the gate drivers 121 to 12*m* may be connected to two or more gate lines GL. The gate drivers 121 to 12*m* may supply voltages to the pixels P through the gate lines GL.

The source driver unit 130 may include source drivers 131 to 13*n*. Each of the source drivers 131 to 13*n* may be connected to two or more source lines SL. The source drivers 131 to 13*n* may supply voltages to the pixels P through the source lines SL.

The timing controller 140 may control the gate drivers 121 to 12*m* and the source drivers 131 to 13*n*. The timing controller 140 may control the gate drivers 121 to 12*m* such that the rows of the pixels P are sequentially selected. The timing controller 140 may control the source drivers 131 to 13*n* to adjust luminance of pixels P of a selected row.

In other words, the timing controller 140 may sequentially select the rows of the pixels and may adjust luminance of the pixels P of the selected row. An image may be displayed through the pixels P by color filters of the pixels P and a combination of luminance of the pixels P. In other words, an image may be displayed through the pixels P by control of the timing controller 140.

As the pixels P increase in number or as the display panel 110 becomes large, a resistance component or a capacitance component formed by the pixels P may increase. When a specific voltage is supplied to source lines SL, the resistance component or the capacitance component may delay a time taken for voltages of the pixels P to arrive at the specific voltage. In other words, a resistance component or a capacitance component of the pixels P may degrade response (e.g., response time) of the pixels P.

To enhance the response of the pixels P, the timing controller 140 may perform overdrive. For example, the timing controller 140 may first supply overdrive voltages to source lines SL and may then supply source line voltages to the source lines SL. The source line voltages may be voltages which should be transmitted to pixels P of a selected row. The overdrive voltages may be higher than source line voltages.

In other words, the timing controller 140 may enhance response of the pixels P as compared with supplying only source line voltages to the pixels P by supplying overdrive voltages which are higher than source line voltages. The timing controller 140 may adjust luminance of the pixels P to target levels by first supplying overdrive voltages and then supplying source line voltages.

The timing controller 140 may include an overdrive controller 141, a pixel value manager 148, and a nonvolatile memory 149. The overdrive controller 141 may calculate overdrive values for pixels P of a selected row depending on current values and previous values of the pixels P of the selected row.

The current values of the pixels P of the selected row may be values corresponding to voltages to be supplied to the pixels of the selected row, that is, source line voltages to be supplied to source lines SL. The previous values of the pixels P of the selected row may be values corresponding to voltages supplied to pixels P of an immediately previously selected row, that is, source line voltages supplied to source lines SL.

The pixel value manager 148 may store the previous values and the current values of the pixels P of the selected row. For example, the pixel value manager 148 may store image data received from an external device (e.g., a graphics processor or a codec). The pixel value manager 148 may provide previous voltage values and current voltage values associated with pixels P of a selected row among the stored image data to the overdrive controller 141.

The nonvolatile memory 149 may store information necessary for generating overdrive voltages, for example, look-up tables (LUTs). As an example, the nonvolatile memory 149 may be included in the timing controller 140. As another example, the nonvolatile memory 149 may be provided outside the timing controller 140 and may communicate with the timing controller 140 through a bus.

Figure 2:
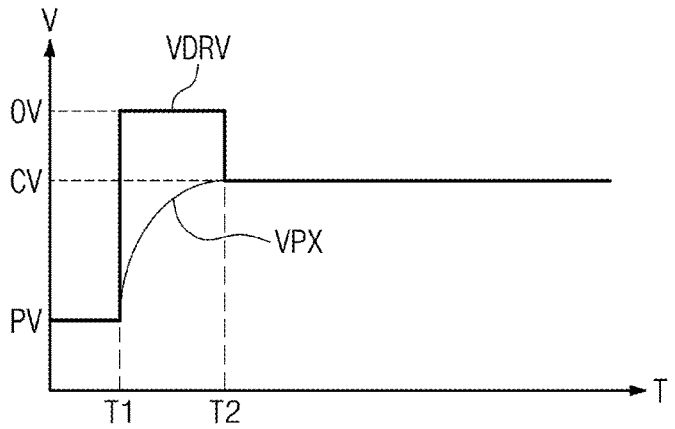
FIG. 2 is a drawing illustrating an example of performing overdrive at a timing controller.

FIG. 2 is a drawing illustrating an example of performing overdrive at a timing controller 140. In FIG. 2, a horizontal axis may represent time T and a vertical axis may represent voltage V. A driving voltage VDRV shows an example of one of voltages supplied to source lines SL at source drivers 131 to 13*n* of FIG. 1. A pixel voltage VPX shows an example in which the driving voltage VDRV is transmitted to one of pixels P of a selected row through one selected among source lines SL.

Referring to FIGS. 1 and 2, before a first time T1, the pixel voltage VPX may have a level corresponding to a previous value PV. For example, due to source line voltages immediately previously supplied to source lines SL, the pixel voltage VPX may be in a state where it is saturated with a voltage of a level corresponding to the previous value PV.

A new row may be selected at the first time T, and an overdrive voltage having a level corresponding to an overdrive value OV may be supplied as the driving voltage VDRV to a source line SL. Since the overdrive value OV is higher than a current value CV, the pixel voltage VPX may have a faster increase than when a source line voltage of the current value CV is supplied.

At a second time T2, the pixel voltage VPX may increase to a level near the current value CV. In this case, a source line voltage having a level corresponding to the current value CV may be supplied to a source line SL. The pixel voltage VPX may converge to a source line voltage having a level corresponding to the current value CV.

In other words, the source drivers 131 to 13*n* may enhance response of voltages of pixels P by supplying overdrive voltages having overdrive values higher than current values to source lines SL. Thereafter, the source drivers 131 to 13*n* may set final voltage levels transmitted to pixels P to current values by supplying source line voltages having current values to source lines SL. Thus, luminance of pixels P may be adjusted to target luminance faster.

Figure 3:
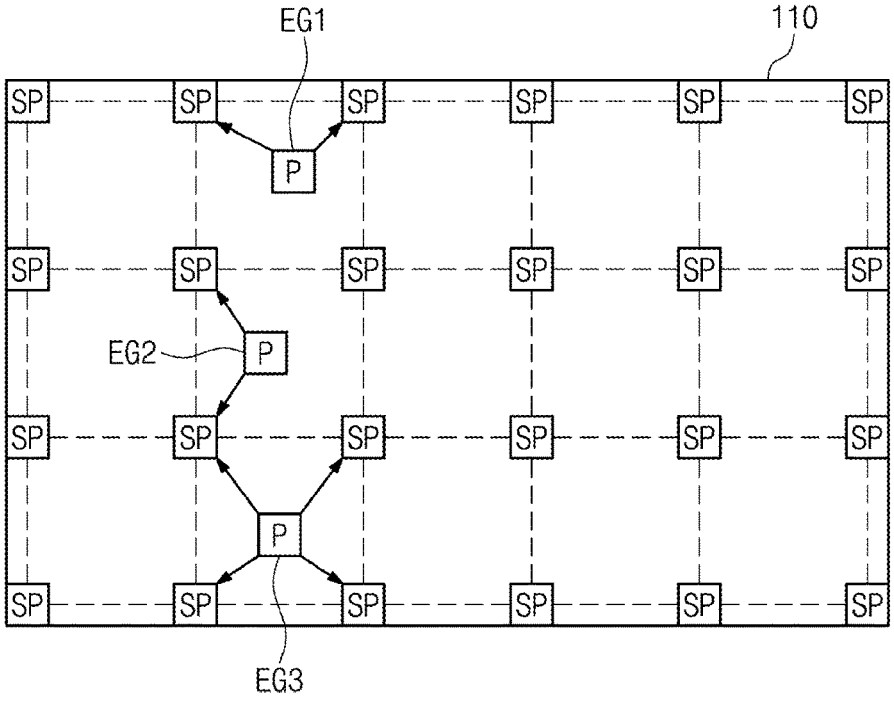
FIG. 3 is a drawing illustrating examples of reference pixels in which look-up tables (LUTs) for calculating overdrive values are specified.

FIG. 3 is a drawing illustrating examples of reference pixels in which LUTs for calculating overdrive values are specified. Referring to FIGS. 1 to 3, some of pixels P of a display panel 110 may be selected as reference pixels SP. LUTs for calculating overdrive values may be assigned to each of the reference pixels SP. As another example, one LUT may be assigned to a reference pixel region which is a set of reference pixels SP.

Overdrive values of pixels P may be calculated according to physical characteristics and operation characteristics of the pixels P. For example, according to positions of the pixels P and according to previous values and current values of the pixels P, overdrive values for the pixels P may differ from each other.

In a selected row, overdrive values of each of pixels P may be calculated according to LUTs associated with adjacent reference pixels SP. For example, as shown in a first example EG1, an overdrive value of a pixel P may be calculated using LUTs of reference pixels SP which are located in the same row and are nearest to the pixel P.

For example, each of overdrive values may be calculated from LUTs of two adjacent reference pixels SP. In a row direction, overdrive values may be interpolated (or be weighted and calculated) according to a distance between a pixel P and reference pixels SP. The result of the interpolation or calculation may be a final overdrive value.

As another example, as shown in a second example EG2, an overdrive value of a pixel P may be calculated using LUTs of reference pixels SP which are located in the same column and are nearest to the pixel P. In a column direction, overdrive values of reference pixels SP may be interpolated (or be weighted and calculated) according to a distance between a pixel P and the reference pixels SP. The result of the interpolation or calculation may be a final overdrive value.

As another example, as shown in a third example EG3, an overdrive value of a pixel P may be calculated using LUTs of the nearest four reference pixels SP. Overdrive values of reference pixels SP may be interpolated (or be weighted and calculated) according to a distance between a pixel P and the reference pixels SP. The result of the interpolation and calculation may be a final overdrive value.

As an example, as shown by a dotted line, reference pixels SP may form rectangular lookup areas. An overdrive value may be calculated using at least two of reference pixels SP of a lookup area to which the specific pixel P belongs, with respect to the specific pixel P of a selected row.

FIG. 4 is a drawing illustrating an example of an LUT associated with one reference pixel SP. Referring to FIGS. 1, 3, and 4, an LUT may include overdrive values (e.g., candidate overdrive values) for some of current values CV or previous values PV. For example, the LUT may include candidate overdrive values when the previous values PV or the current values CV are "0, 16, 32, 48, 64, 80, 96, 112, 128, 144, 160, 176, 192, 208, 224, and 255".

The LUT may include candidate overdrive values of A1 to A16, B1 to B16, C1 to C16, D1 to D16, E1 to E16, F1 to F16, G1 to G16, H1 to H16, I1 to I16, J1 to J16, K1 to K16, L1 to L16, M1 to M16, N1 to N16, O1 to O16, and P1 to P16 depending on the current values CV and the previous values PV.

The LUT may output four candidate overdrive values for a specific pixel. For example, when a previous value PV of the specific pixel is 40 and when a current value CV is 52, candidate overdrive values adjacent to the previous value PV and the current value CV of the specific pixel may be output. For example, the LUT may output candidate overdrive values D3, D4, E3, and E4 shown by a bold rectangle.

Reference pixels SP may have different LUTs. For example, the different LUTs may have different candidate overdrive values for the same current value CV and the same previous value PV. Since the reference pixels SP have the different LUTs, valid candidate overdrive values may be changed according to a position of a pixel P and an overdrive value OV may be changed. An overdrive value OV may be determined by reflecting a characteristic difference according to a position of a pixel P.

Figure 5:
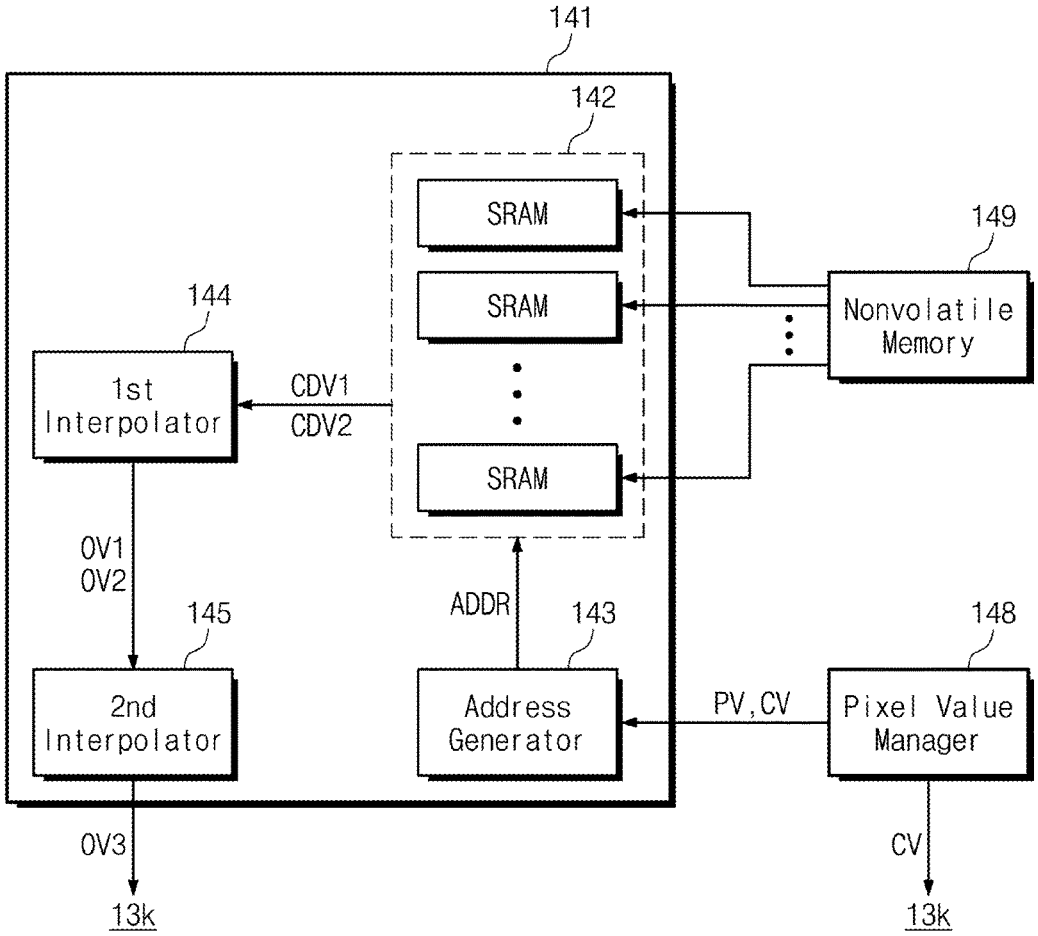
FIG. 5 is a block diagram illustrating an overdrive controller, a pixel value manager, and a nonvolatile memory according to an example embodiment.

FIG. 5 is a block diagram illustrating an overdrive controller 141, a pixel value manager 148, and a nonvolatile memory 149 according to an example embodiment. Referring to FIGS. 1 and 5, the overdrive controller 141 may include a memory 142, an address generator 143, a first interpolator 144, and a second interpolator 145.

As an example, the configuration of the overdrive controller 141 for calculating an overdrive value for one specific pixel is shown in FIG. 5. Overdrive values of pixels of a selected row may be calculated in parallel or sequentially using the same configuration as that shown in FIG. 5.

As an example, an example (e.g., a first example EG1 of FIG. 3) of calculating an overdrive value using LUTs of reference pixels which belong to the same row and are nearest to a specific pixel is assumed. However, embodiments of the inventive concept are not limited thereto. For example, an overdrive value may be calculated according to a second example EG2 or a third example EG3.

The memory 142 may include static random access memories (SRAMs). If power is supplied to a display device 100, the memory 142 may read LUTs from the nonvolatile memory 149 and may store the read LUTs. For example, the memory 142 may store all or some of LUTs stored in the nonvolatile memory 149.

The address generator 143 may receive a previous value PV and a current value CV from a pixel value manager 148. According to the previous value PV and the current value CV, the address generator 143 may generate an address ADDR of the memory 142. The address ADDR may indicate a storage area of the memory 142 which stores LUTs adjacent to a specific pixel and candidate overdrive values corresponding to the previous value PV and the current value CV in the adjacent LUTs.

According to the address ADDR, the memory 142 may read first candidate overdrive values CDV1 from a first LUT associated with the specific pixel. According to the address ADDR, the memory 142 may read second candidate overdrive values CDV2 from a second LUT associated with the specific pixel. The memory 142 may output the first and second candidate overdrive values CDV1 and CDV2 to the first interpolator 144.

The first interpolator 144 may interpolate the first candidate overdrive values CDV1 of the first LUT to calculate a first overdrive value OV1. The first interpolator 144 may interpolate the second candidate overdrive values CDV2 of the second LUT to calculate a second overdrive value OV2. As an example, the first interpolator 144 may calculate the first or second overdrive value OV1 or OV2 based on Equation 1.

$$OV = \frac{c \cdot \frac{aD3 + bD4}{2} + d \cdot \frac{aE3 + bE4}{2}}{2} \quad \text{[Equation 1]}$$

In Equation 1, as described with reference to FIG. 4, D3 may indicate an upper left candidate overdrive value, D4 may indicate an upper right candidate overdrive value, E3 may indicate a lower left candidate overdrive value, and E4 may indicate a lower right candidate overdrive value. The value "a" may denote a ratio of a difference between a previous value PV and D3 to a difference between D3 and D4 and may be calculated using Equation 2.

$$a = \frac{D3}{D3 + D4} \quad \text{[Equation 2]}$$

The value "b" may indicate a ratio of a difference between a previous value PV and D4 to a difference between D3 and D4. The value "b" may be calculated by subtracting "a" from 1. The value "c" may indicate a ratio of a difference between a current value CV and D3 to a difference between D3 and E3 and may be calculated using Equation 3.

$$c = \frac{D3}{D3 + E3} \quad \text{[Equation 3]}$$

The value "d" may indicate a ratio of a difference between the current value CV and E3 to a difference between D3 and E3. The value "d" may be calculated by subtracting "c" from 1. The first and second overdrive values OV1 and OV2 may be transmitted to the second interpolator 145.

The second interpolator 145 may interpolate the first and second overdrive values OV1 and OV2 to calculate a third overdrive value OV3. The third overdrive value OV3 may be calculated based on Equation 4.

$$OV3 = \frac{eOV1 + fOV2}{2} \quad \text{[Equation 4]}$$

In Equation 4, the value "e" may indicate a ratio of a distance between the specific pixel and a first reference pixel to a distance between first and second reference pixels in a lookup area to which a specific pixel belongs. The value "e" may be calculated using Equation 5.

$$e = \frac{x3 - x1}{x2 - x1} \quad \text{[Equation 5]}$$

In Equation 5, x2 may be a coordinate (e.g., an x-coordinate) in a row direction of the second reference pixel, x1 may be a coordinate in a row direction of the first reference pixel. The coordinate x2 may be larger than x1. The coordinate x3 may be a coordinate in a row direction of a specific pixel. The value "f" may indicate a ratio of a distance between the specific pixel and the second reference pixel to a distance between the first and second reference pixels in a lookup area to which the specific pixel belongs. The value "f" may be obtained by subtracting "e" from 1.

For example, "e" may be a ratio when it is assumed that the specific pixel and the first and second reference pixels are located in the same row, that is, a ratio of distances in the row direction. The third overdrive value OV3 may be a final overdrive value and may be transmitted to a source driver 13*k* (where k is an integer which is greater than or equal to 1 and is less than or equal to n) associated with the specific pixel.

The pixel value manager 148 may transmit the current value CV to the source driver 13*k* associated with the specific pixel. The source driver 13*k* may supply an overdrive voltage to a source line depending on the third overdrive value OV3 and may supply a source line voltage to the source line depending on the current value CV.

Figure 6:
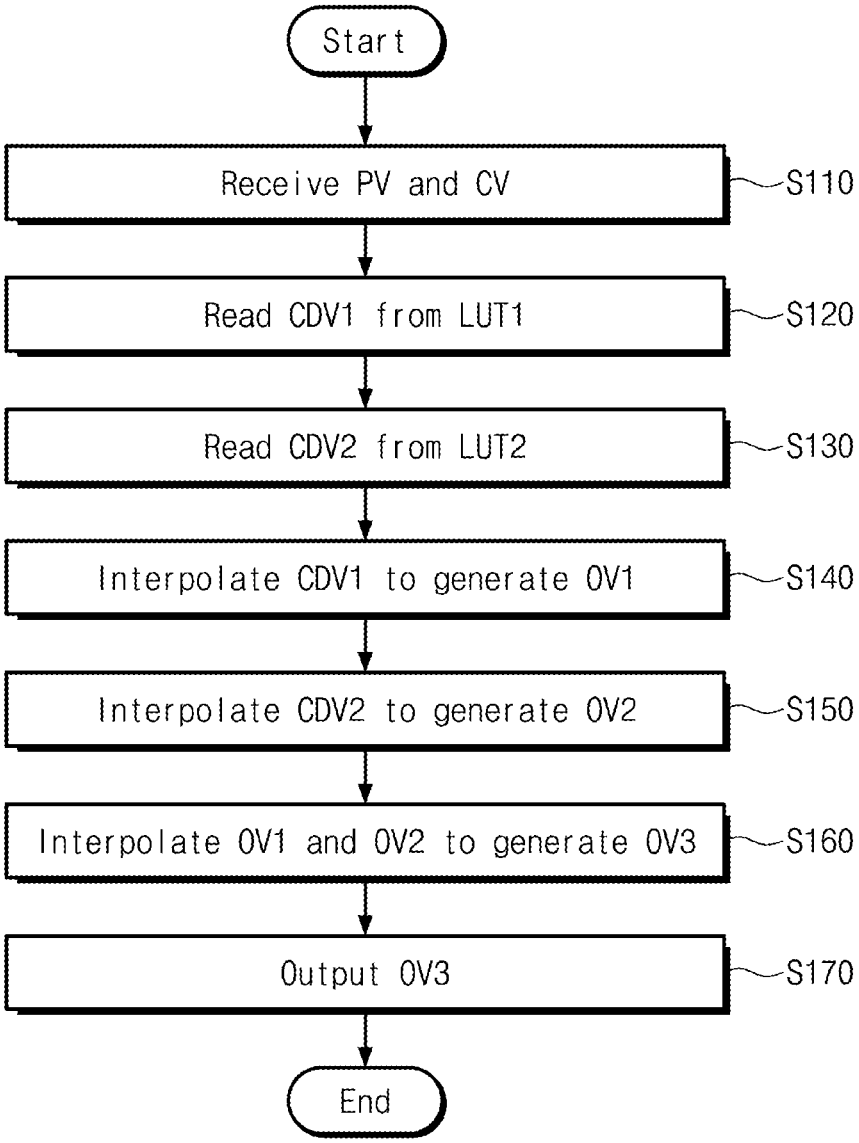
FIG. 6 is a flowchart illustrating an operation method of an overdrive controller according to an example embodiment.

FIG. 6 is a flowchart illustrating an operation method of an overdrive controller 141 according to an example embodiment. Referring to FIGS. 1, 5, and 6, in operation S110, the overdrive controller 141 may receive a previous value PV and a current value CV from a pixel value manager 148. An address generator 143 may generate an address ADDR depending on the previous value PV and the current value CV.

In operation S120, the overdrive controller 141 may read first candidate overdrive values CDV1 from a memory 142 using the address ADDR. The overdrive controller 141 may read the first candidate overdrive values CDV1 from a first LUT1 of a first reference pixel adjacent to a specific pixel.

In operation S130, the overdrive controller 141 may read second candidate overdrive values CDV2 from the memory 142 using the address ADDR. The overdrive controller 141 may read the second candidate overdrive values CDV2 from a second LUT LUT2 of a second reference pixel adjacent to the specific pixel.

In operation S140, the overdrive controller 141 may interpolate the first candidate overdrive values CDV1 to generate a first overdrive value OV1. In operation S150, the overdrive controller 141 may interpolate the second candidate overdrive values CDV2 to generate a second overdrive value OV2.

In operation S160, the overdrive controller 141 may interpolate the first overdrive value OV1 and the second overdrive value OV2 to generate a third overdrive value OV3. In operation S170, the overdrive controller 141 may output the third overdrive value OV3 as a final overdrive value.

As an example, operations S110 to S170 may be performed for each of pixels of a selected row. In other words, each of overdrive values for the pixels of the selected row may be calculated. The overdrive values of the pixels of the selected row may be calculated in parallel or sequentially.

Figure 7A:
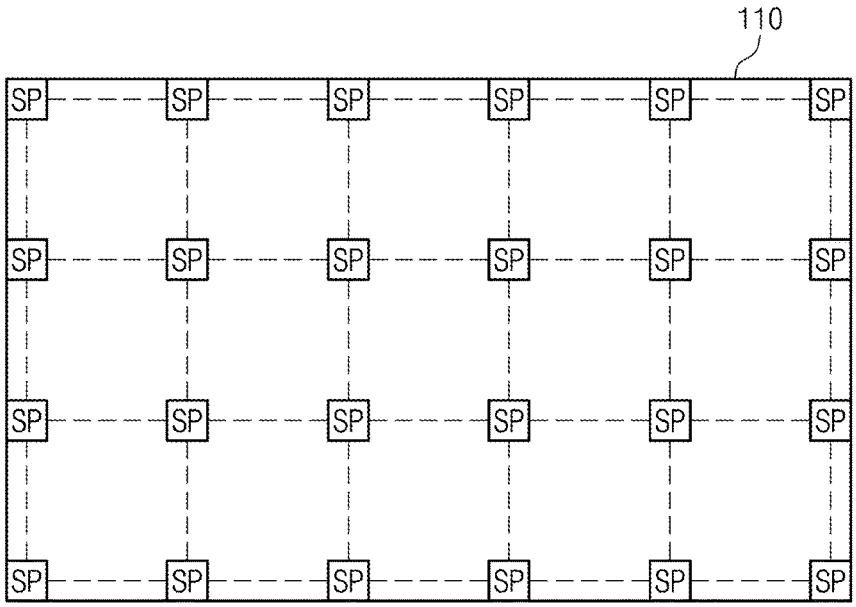
FIG. 7A is a drawing illustrating a display panel.
Figure 7B:
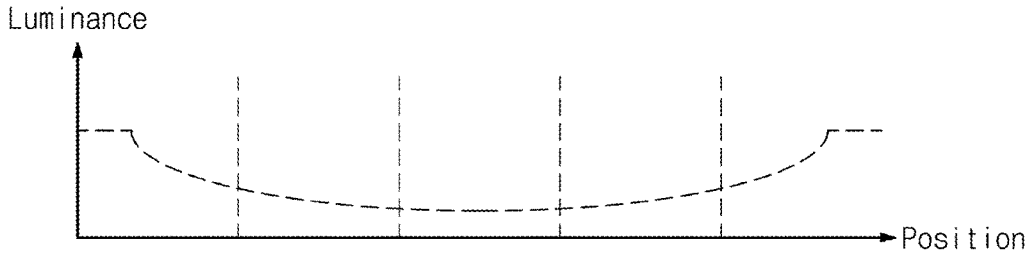
FIG. 7B is a drawing illustrating a change in luminance according to a position of a display panel.
Figure 7C:
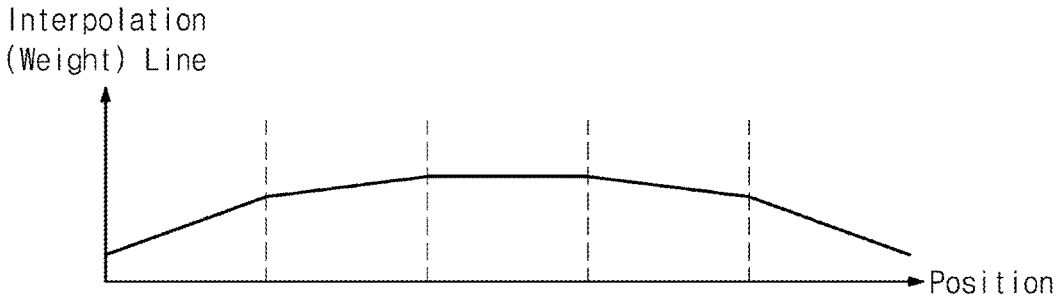
FIG. 7C is a drawing illustrating an example of an interpolation method for compensating for a change in luminance.

FIG. 7A is a drawing illustrating a display panel 110. FIG. 7B is a drawing illustrating a change in luminance according to a position of a display panel 110. FIG. 7C is a drawing illustrating an example of an interpolation method for compensating for a change in luminance. Referring to FIGS. 1, 5, and 7A to 7C, as pixels P are more distant from gate drivers 121 to 12*m*, they may decrease in luminance more.

To compensate for a change in luminance of the pixels P, a second interpolator 145 may perform interpolation depending on an interpolation line (or a weight line). The interpolation line may have an inverse form of a luminance curve. The second interpolator 145 may calculate a value of the interpolation line (or the weight line) depending on a position of a row direction of a specific pixel and may perform interpolation by using the calculated value as a weight value.

In other words, the pixels P may be divided into groups according to a change in luminance. Different interpolation weight values may be applied to each of the groups according to a change in luminance. The interpolation weight value may be weighted to an overdrive value which is nearer to the gate drivers 121 to 12*m* among overdrive values of reference pixels SP or may be weighted to an overdrive value which is more distant from the gate drivers 121 to 12*m* among the overdrive values of the reference pixels SP.

For example, a weight value may be applied to coefficients e and f of Equation 4. While the sum of the coefficients e and f is kept at 1, a value of each of the coefficient e and f may be adjusted according to an interpolation line (or a weight line). For example, as a value of the interpolation line (or the weight line) increases more, a value of the coefficient e or f may decrease or increase more and a value of the coefficient f or e increases or decreases more.

Figure 8:
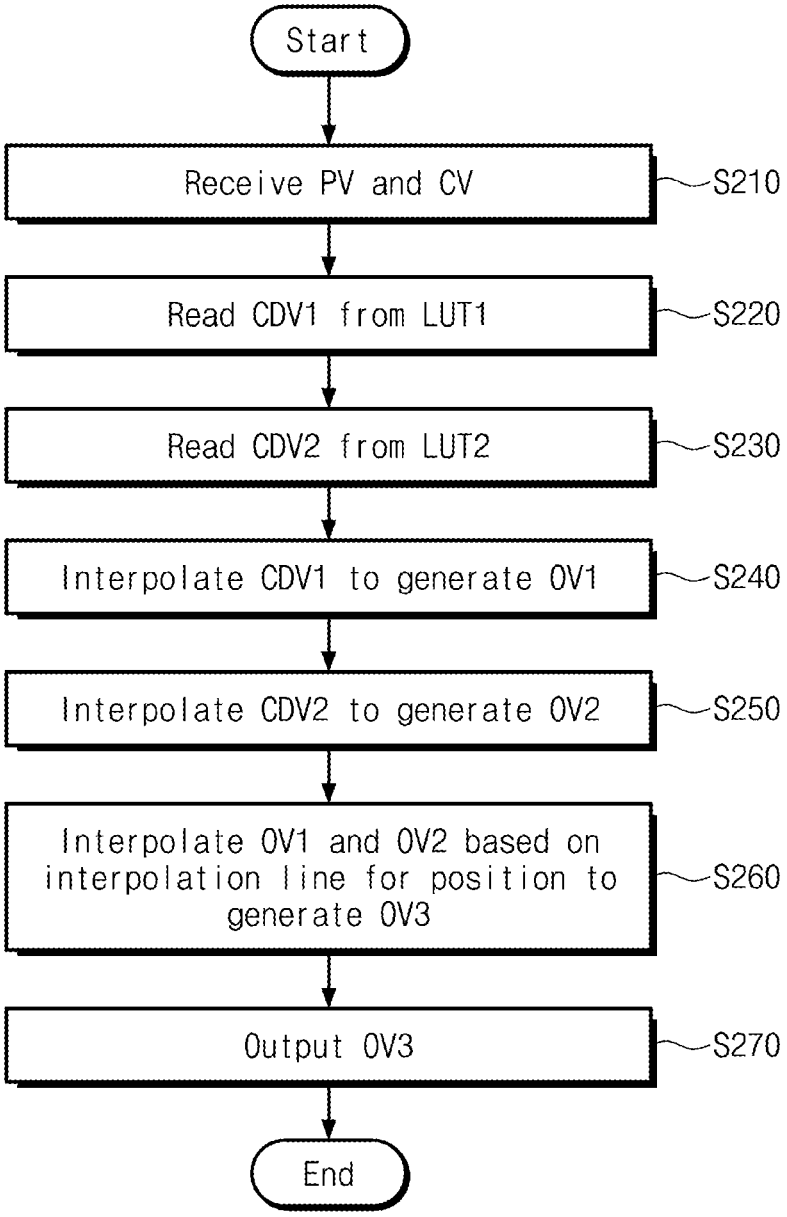
FIG. 8 is a flowchart illustrating an operation method of an overdrive controller using an interpolation line of FIG. 7C.

FIG. 8 is a flowchart illustrating an operation method of an overdrive controller 141 using an interpolation line of FIG. 7C. Referring to FIGS. 1, 5, 7C, and 8, operations S210 to S250 may be performed in the same manner as operations S110 to S150. Thus, a description for operations S210 to S250 will be omitted.

In operation S260, a second interpolator 145 may interpolate first and second overdrive values OV1 and OV2 based on an interpolation line (or a weight line) for a position to generate a third overdrive value OV3. In operation S270, the second interpolator 145 may output the third overdrive value OV3 as a final overdrive value.

As an example, operations S210 to S270 may be performed for each of pixels of a selected row. In other words, each of overdrive values for the pixels of the selected row may be calculated separately. The overdrive values of the pixels of the selected row may be calculated in parallel or sequentially.

Figure 9A:
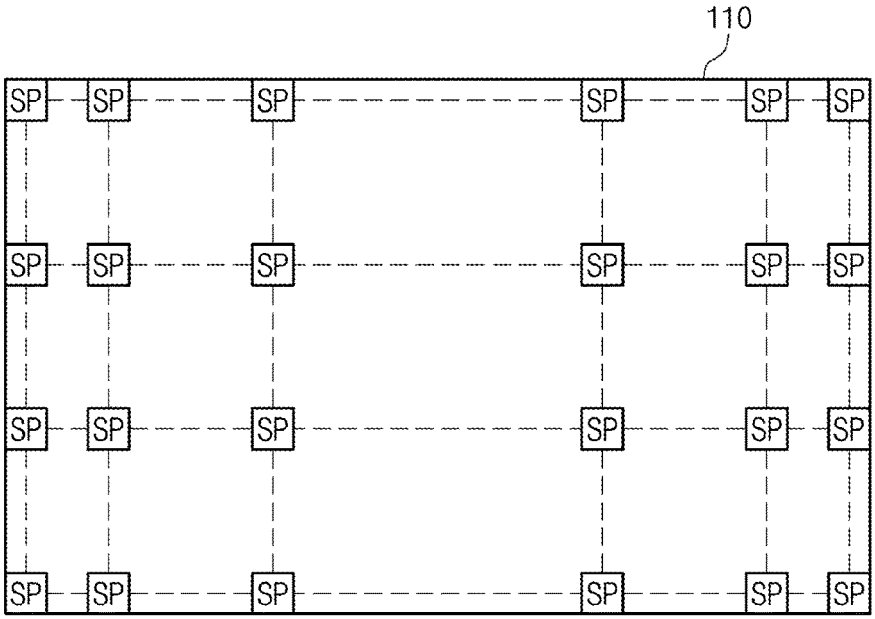
FIG. 9A is a drawing illustrating a display panel in which positions of reference pixels are adjusted.
Figure 9B:
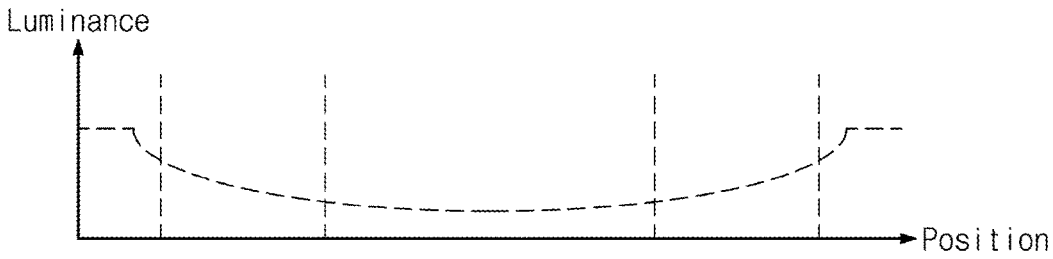
FIG. 9B is a drawing illustrating a change in luminance according to a position of a display panel.
Figure 9C:
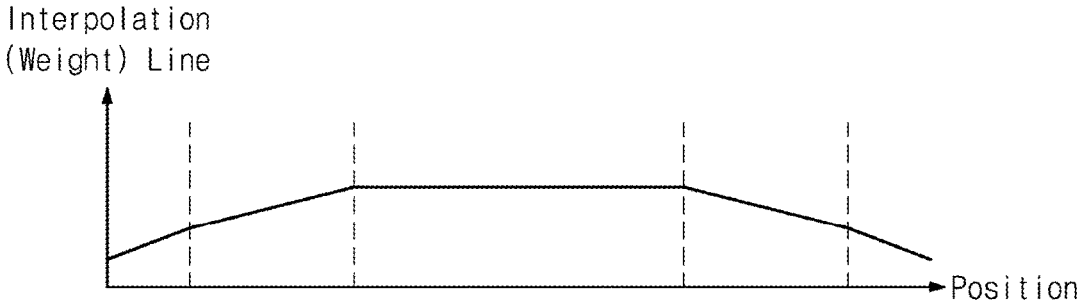
FIG. 9C is a drawing illustrating an example of an interpolation method for compensating for a change in luminance.

FIG. 9A is a drawing illustrating a display panel 110 in which positions of reference pixels are adjusted. FIG. 9B is a drawing illustrating a change in luminance according to a position of a display panel 110. FIG. 9C is a drawing illustrating an example of an interpolation method for compensating for a change in luminance. Referring to FIGS. 1, 5, and 9A to 9C, as pixels P are more distant from gate drivers 121 to 12*m*, they may decrease more in luminance.

To compensate for a change in luminance of the pixels P, a second interpolator 145 may perform interpolation depending on an interpolation line (or a weight line). The interpolation line may have an inverse form of a luminance curve. Intervals of reference pixels SP, for example, intervals according to a row direction may differ from each other.

For example, the intervals of the reference pixels SP may be set to compensate for a change in luminance of the pixels P. In an area with a large change in luminance of the pixels P along the row direction, a first interval of the reference pixels SP may be set to be narrow. In an area with a relatively small change in luminance of the pixels P along the row direction, a second interval of the reference pixels SP may be set to be wider than the first interval.

If intervals of the reference pixels SP are adjusted (e.g., having non-uniform intervals) according to a change in luminance of the pixels P, performance of compensating for a change in luminance may be enhanced using the same number of reference pixels SP. Further, if intervals of the reference pixels SP are adjusted according to a change in luminance of the pixels P, the same or similar performance of compensating for a change in luminance to a previous state may be accomplished using a fewer reference pixels SP.

As described above, an overdrive controller 141 according to an example embodiment may calculate overdrive values of compensating for a change in luminance according to positions of pixels P on a display panel 110. Thus, an image distortion or an artifact occurred according to a change in luminance of the pixels P may be prevented, and an image may increase in quality.

Figure 10:
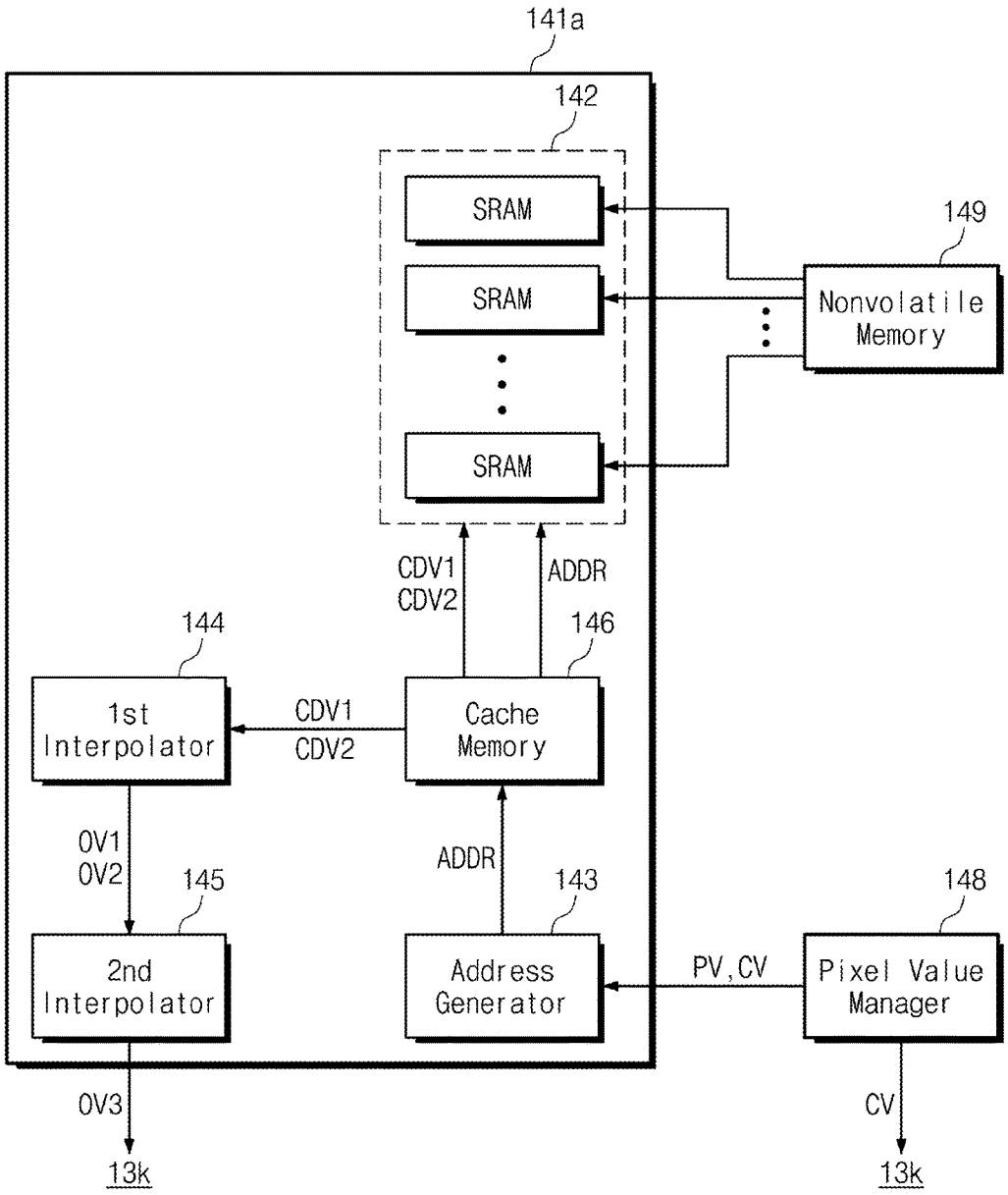
FIG. 10 is a block diagram illustrating an overdrive controller, a pixel value manager, and a nonvolatile memory according to an example embodiment.

FIG. 10 is a block diagram illustrating an overdrive controller 141*a*, a pixel value manager 148, and a nonvolatile memory 149 according to an example embodiment. Referring to FIGS. 1 and 10, the overdrive controller 141*a* may include a memory 142, an address generator 143, a first interpolator 144, a second interpolator 145, and a cache memory 146.

The memory 142, the address generator 143, the first interpolator 144, and the second interpolator 145 may operate in the same manner as described with reference to FIG. 5. Thus, a detailed description for the memory 142, the address generator 143, the first interpolator 144, and the second interpolator 145 will be omitted.

Compared with FIG. 5, the overdrive controller 141*a* may further include the cache memory 146. The cache memory 146 may receive an address ADDR from the address generator 143. When first and second candidate overdrive values CDV1 and CDV2 (or one of the first and second candidate overdrive values CDV1 and CDV2) corresponding to the address ADDR are stored in the cache memory 146 (e.g., upon encountering a cache hit), the cache memory 146 may output the stored first and second candidate overdrive values CDV1 and CDV2 (or the stored one of the first and second candidate overdrive values CDV1 and CDV2) to the first interpolator 144.

When the first and second candidate overdrive values CDV1 and CDV2 (or the one of the first and second candidate overdrive values CDV1 and CDV2) corresponding to the address ADDR are not stored in the cache memory 146 (e.g., upon encountering a cache miss), the cache memory 146 may output the address ADDR associated with the first and second candidate overdrive values CDV1 and CDV2 (or the one of the first and second candidate overdrive values CDV1 and CDV2) to the memory 142.

The memory 142 may output the first and second candidate overdrive values CDV1 and CDV2 (or the one of the first and second candidate overdrive values CDV1 and CDV2) to the cache memory 146 depending on the address ADDR. The cache memory 146 may store the first and second candidate overdrive values CDV1 and CDV2 (or the one of the first and second candidate overdrive values CDV1 and CDV2) received from the memory 142 and may transmit the stored first and second candidate overdrive values CDV1 and CDV2 (or the stored one of the first and second candidate overdrive values CDV1 and CDV2) to the first interpolator 144.

As an example, the cache memory 146 may provide two or more cache lines for each SRAM of the memory 142. The cache memory 146 may provide only a read cache function and may fail to provide a write cache function. The cache memory 146 may manage candidate overdrive values in a first-in first-out (FIFO) mode or a least recently used (LRU) way.

As an example, the configuration of the overdrive controller 141*a* for calculating an overdrive value for one specific pixel is shown in FIG. 10. Overdrive values of pixels of a selected row may be calculated in parallel or sequentially using the same configuration as being shown in FIG. 10.

As an example, as described with reference to FIGS. 7A to 8, the second interpolator 145 may be configured to interpolate the first and second overdrive values OV1 and OV2 based on an interpolation line (or a weight line). As described with reference to FIGS. 9A to 9C, intervals of reference pixels SP may be set in a different way according to an amount of change in luminance.

Figure 11:
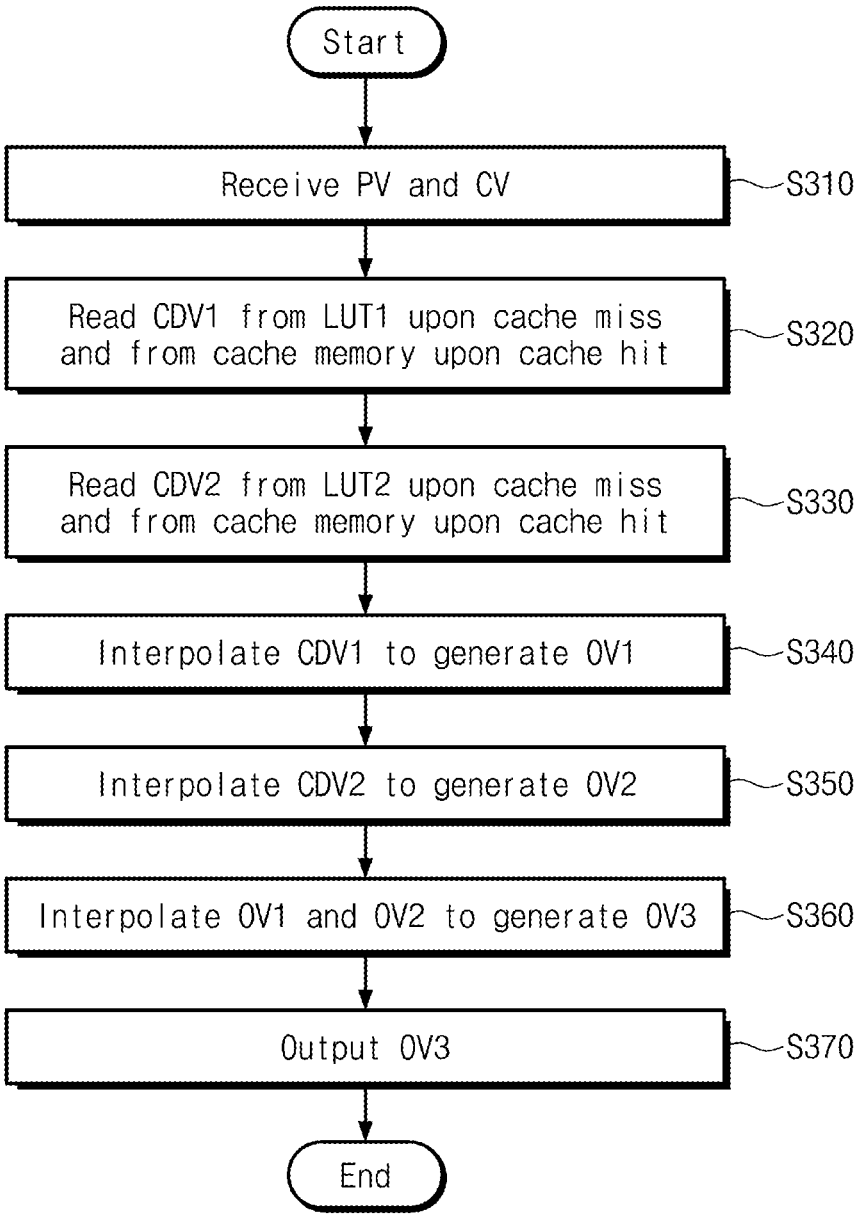
FIG. 11 is a flowchart illustrating an operation method of an overdrive controller of FIG. 10.

FIG. 11 is a flowchart illustrating an operation method of an overdrive controller 141*a* of FIG. 10. Referring to FIGS. 1, 10, and 11, in operation S310, the overdrive controller 141*a* may receive a previous value PV and a current value CV from a pixel value manager 148.

In operation S320, the overdrive controller 141*a* may read first candidate overdrive values CDV1 from a first LUT LUT1 upon having a cache miss and may read the first candidate overdrive values CDV1 from a cache memory 146 upon having a cache hit. In operation S330, the overdrive controller 141*a* may read second candidate overdrive values CDV2 from a second LUT LUT2 upon having a cache miss and may read the second candidate overdrive values CDV2 from the cache memory 146 upon having a cache hit.

Operations S340 to S370 may be performed in the same manner as operations S140 to S170. A detailed description for operations S340 to S370 will be omitted. As an example, operations S310 to S370 may be performed for each of pixels of a selected row. In other words, each of overdrive values for the pixels of the selected row may be calculated individually. The overdrive values of the pixels of the selected row may be calculated in parallel or sequentially.

As described above, if the cache memory 146 is provided, the number of times (or frequency) of accessing a memory 142 may be reduced. Thus, power consumed by the use of the memory 142 may be reduced, and power consumption of the overdrive controller 141*a* including the memory 142 and a display device 100 may be saved.

Figure 12:
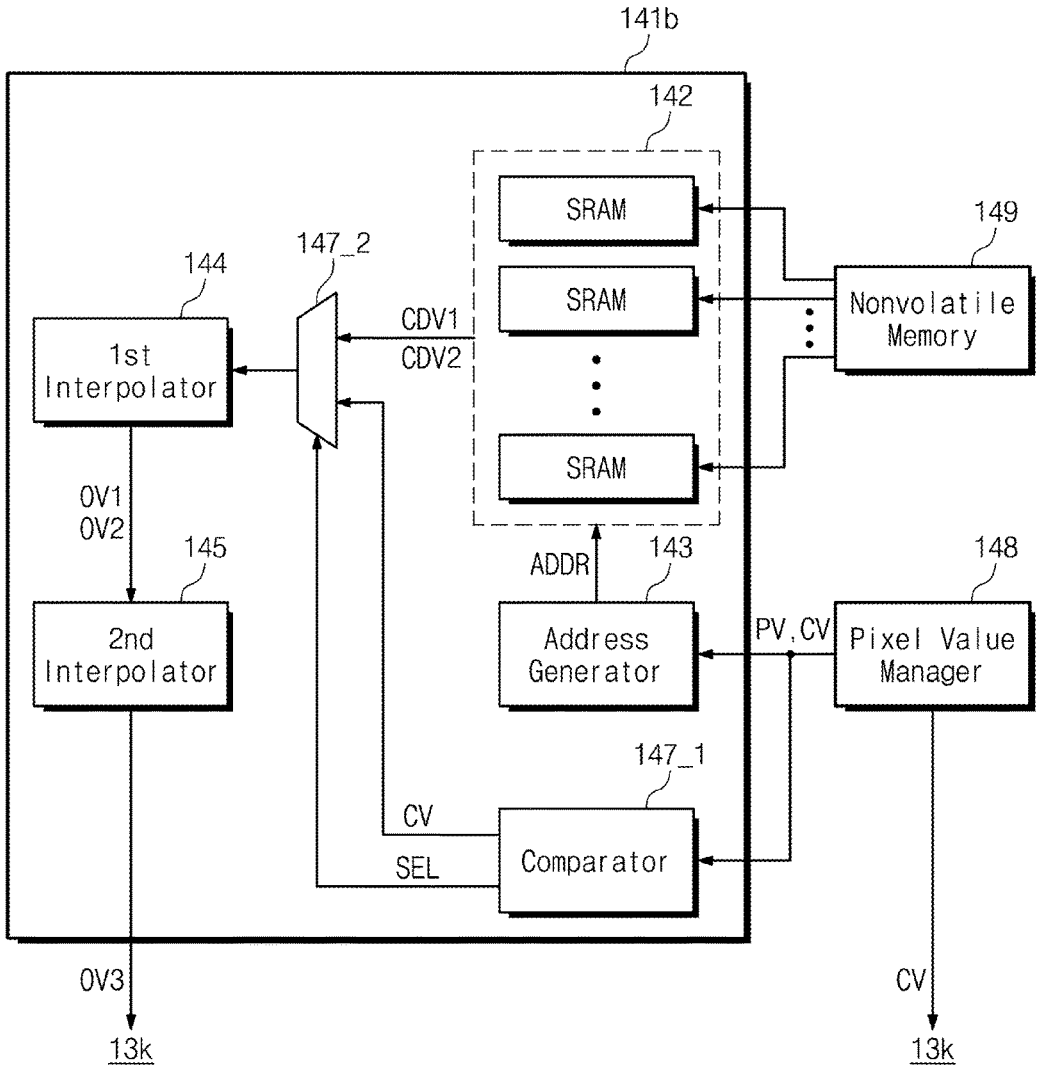
FIG. 12 is a block diagram illustrating an overdrive controller, a pixel value manager, and a nonvolatile memory according to an example embodiment.

FIG. 12 is a block diagram illustrating an overdrive controller 141*b*, a pixel value manager 148, and a nonvolatile memory 149 according to another embodiment of the inventive concept. Referring to FIGS. 1 and 12, the overdrive controller 141*b* may include a memory 142, an address generator 143, a first interpolator 144, a second interpolator 145, a comparator 147_1, and a multiplexer 147_2.

The memory 142, the address generator 143, the first interpolator 144, and the second interpolator 145 may operate in the same manner as being described with reference to FIG. 5. Thus, a detailed description for the memory 142, the address generator 143, the first interpolator 144, and the second interpolator 145 will be omitted.

Compared with FIG. 5, the overdrive controller 141*b* may further include the comparator 147_1, and the multiplexer 147_2. The comparator 147_1 may receive a previous value PV and a current value CV. The comparator 147_1 may detect whether the previous value PV is identical to the current value CV or at least their difference is below a threshold value.

For example, if a difference between the previous value PV and the current value CV is less than a threshold, the comparator 147_1 may detect no change between the previous value PV and the current value CV. If the difference between the previous value PV and the current value CV is greater than or equal to the threshold, the comparator 147_1 may detect a change between the previous value PV and the current value CV.

If the change is not detected, the comparator 147_1 may output the current value CV and may activate a selection signal SEL. If the change is detected, the comparator 147_1 may deactivate the selection signal SEL. If the change is detected, the comparator 147_1 may not output the current value CV.

The multiplexer 147_2 may operate in response to the selection signal SEL. If the selection signal SEL is activated, that is, if there is no change between the previous value PV and the current value CV are identical, the multiplexer 147_2 may transmit the current value CV, transmitted from the comparator 147_1, to the first interpolator 144.

The first interpolator 144 may perform interpolation using the current value CV. In other words, first and second overdrive values OV1 and OV2 may be calculated as the same value as the current value CV. If each of the first and second overdrive values OV1 and OV2 is the same as the current value CV, a third overdrive value OV3 calculated by the second interpolator 145 may also be the same as the current value CV.

If the selection signal SEL is deactivated, that is, if there is a change between the previous value PV and the current value CV, the multiplexer 147_2 may transmit first and second candidate overdrive values CDV1 and CDV2, output from the memory 142, to the first interpolator 144. As described with reference to FIGS. 5 and 6, the first interpolator 144 may perform interpolation using the first and second candidate overdrive values CDV1 and CDV2.

In an LUT described with reference to FIG. 4, if a difference between a previous value PV and a current value CV is less than a threshold, distortion may occur in interpolation of the first interpolator 144. For example, if the previous value PV is 50 and if the current value CV is 50, the first and second overdrive values should be calculated as 50, respectively.

However, if the first interpolator 144 performs interpolation using the LUT, another value, such as "50.xxx", which is approximate to 50, may be calculated. To prevent such distortion, the comparator 147_1 may detect a change between the previous value PV and the current value CV. If the change is not detected, the overdrive controller 141*b* may output the current value CV as a final overdrive value without performing interpolation using LUTs stored in the memory 142.

As an example, the configuration of the overdrive controller 141*b* for calculating an overdrive value for one specific pixel is shown in FIG. 12. Overdrive values of pixels of a selected row may be calculated in parallel or sequentially using the same configuration as being shown in FIG. 12.

As an example, as described with reference to FIGS. 7A to 8, the second interpolator 145 may be configured to interpolate the first and second overdrive values OV1 and OV2 based on an interpolation line (or a weight line). As described with reference to FIGS. 9A to 9C, intervals of reference pixels SP may be set differently according to an amount of a change in luminance. As an example, as described with reference to FIG. 10, the overdrive controller 141*b* may further include a cache memory 146.

Figure 13:
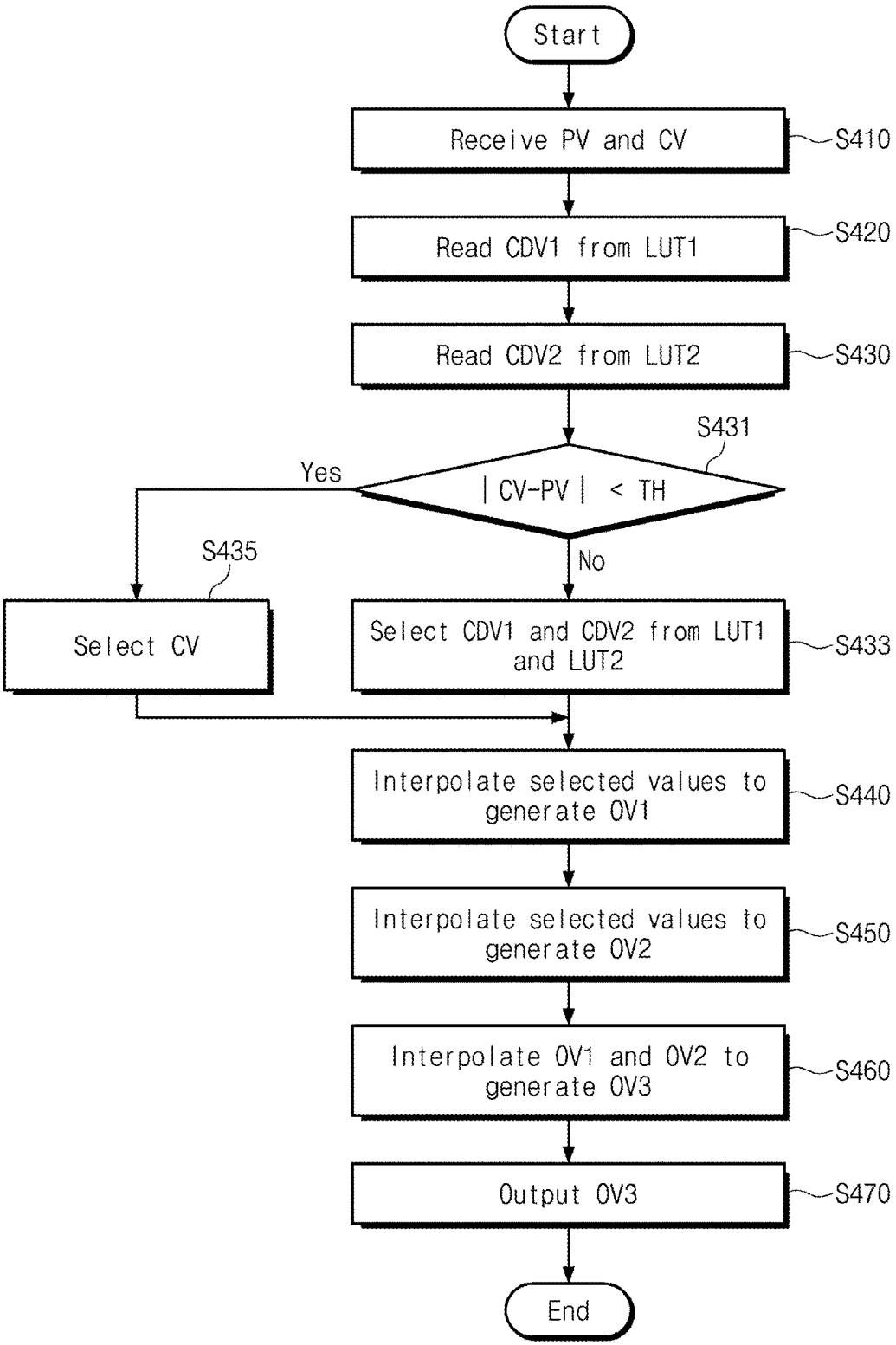
FIG. 13 is a flowchart illustrating an operation method of an overdrive controller of FIG. 12.

FIG. 13 is a flowchart illustrating an operation method of an overdrive controller 141*b* of FIG. 12. Referring to FIGS. 1, 12, and 13, operations S410 to S430 may be performed in the same manner as operations S110 to S130. Thus, a detailed description for operations S410 to S430 will be omitted.

In operation S431, a comparator 147_1 may detect any change between a previous value PV and a current value CV. For example, if an absolute value of a value obtained by subtracting the previous value PV from the current value CV is less than a threshold TH, no change may be detected. In operation S435, a multiplexer 147_2 may select the current value CV depending on a selection signal SEL.

If the absolute value of the value obtained by subtracting the previous value PV from the current value CV is greater than or equal to the threshold TH, a change may be detected. In operation 433, the multiplexer 147_2 may select first and second candidate overdrive values CDV1 and CDV2 of first and second LUTs output from a memory 142 depending on the selection signal SEL.

The multiplexer 147_2 may transmit the selected values to a first interpolator 144. In operation S440, the first interpolator 144 may interpolate the selected values to generate a first overdrive value OV1. In operation S450, the first interpolator 144 may interpolate the selected values to generate a second overdrive value OV2.

When the current value CV is selected, interpolation may be performed using the current value CV. In other words, each of the first and second overdrive values OV1 and OV2 may be same as the current value CV. When the first and second candidate overdrive values CDV1 and CDV2 are selected, interpolation may be performed in the same manner as operations S140 and S150.

Operations S460 and S470 may be performed in the same manner as operations S160 and S170. A detailed description for operations S460 and S470 will be omitted. As an example, operations S410 to S470 may be performed for each of pixels of a selected row. In other words, each of overdrive values for the pixels of the selected row may be calculated individually. The overdrive values of the pixels of the selected row may be calculated in parallel or sequentially.

Figure 14:
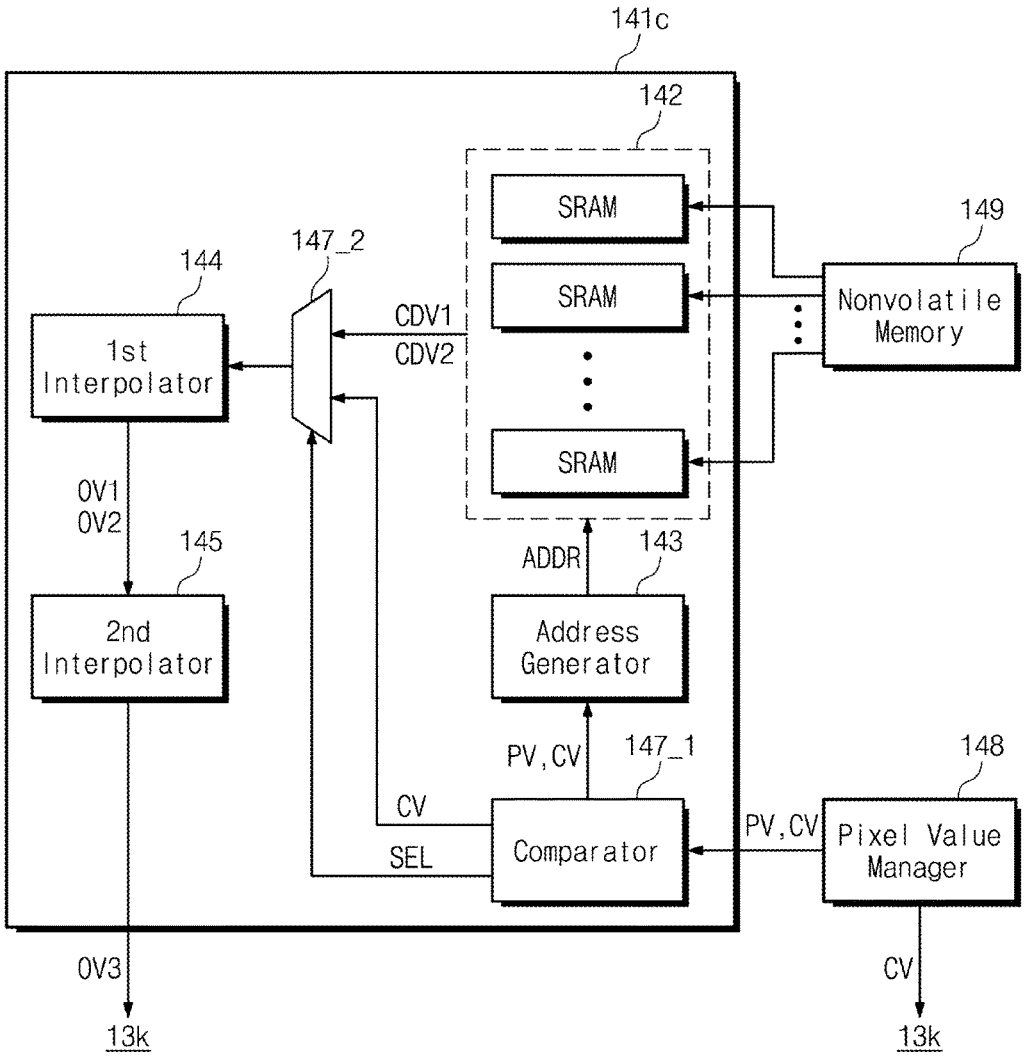
FIG. 14 is a block diagram illustrating an application example of an overdrive controller of FIG. 12.

FIG. 14 is a block diagram illustrating an application example of an overdrive controller 141*b* of FIG. 12. Referring to FIGS. 1 and 14, an overdrive controller 141*c* may include a memory 142, an address generator 143, a first interpolator 144, a second interpolator 145, a comparator 147_1, and a multiplexer 147_2.

The memory 142, the address generator 143, the first interpolator 144, and the second interpolator 145 may operate in the same manner as being described with reference to FIG. 5. Thus, a detailed description for the memory 142, the address generator 143, the first interpolator 144, and the second interpolator 145 will be omitted.

The comparator 147_1 may receive a previous value PV and a current value CV. If no change between the previous value PV and the current value CV is detected, the comparator 147_1 may output the current value CV to the multiplexer 147_2 and may activate a selection signal SEL. If a change is detected, the comparator 147_1 may transmit the previous value PV and the current value CV to the address generator 143 and may deactivate the selection signal SEL.

As described with reference to FIG. 12, the multiplexer 147_2 may transmit the current value CV or first and second candidate overdrive values CDV1 and CDV2 to the first interpolator 144 depending on the selection signal SEL. In other words, only when there is a change between the previous value PV and the current value CV, the address generator 143 may generate an address ADDR and the memory 142 may output the first and second candidate overdrive values CDV1 and CDV2.

When there is no change between the previous value PV and the current value CV, the address generator 143 may not generate the address ADDR and the memory 142 may not output the first and second candidate overdrive values CDV1 and CDV2. Since the memory 142 and the address generator 143 are operated only when there is a change between the previous value PV and the current value CV, power consumption of the overdrive controller 141*c*, a timing controller 140, and a display device 100 may be reduced.

As an embodiment, the configuration of the overdrive controller 141*c* for calculating an overdrive value for one specific pixel is shown in FIG. 14. Overdrive values of pixels of a selected row may be calculated in parallel or sequentially using the same configuration as being shown in FIG. 14.

As an example, as described with reference to FIGS. 7A to 8, the second interpolator 145 may be configured to interpolate the first and second overdrive values OV1 and OV2 based on an interpolation line (or a weight line). As described with reference to FIGS. 9A to 9C, intervals of reference pixels SP may be set differently according to an amount of a change in luminance. As an example, as described with reference to FIG. 10, the overdrive controller 141*b* may further include a cache memory 146.

Figure 15:
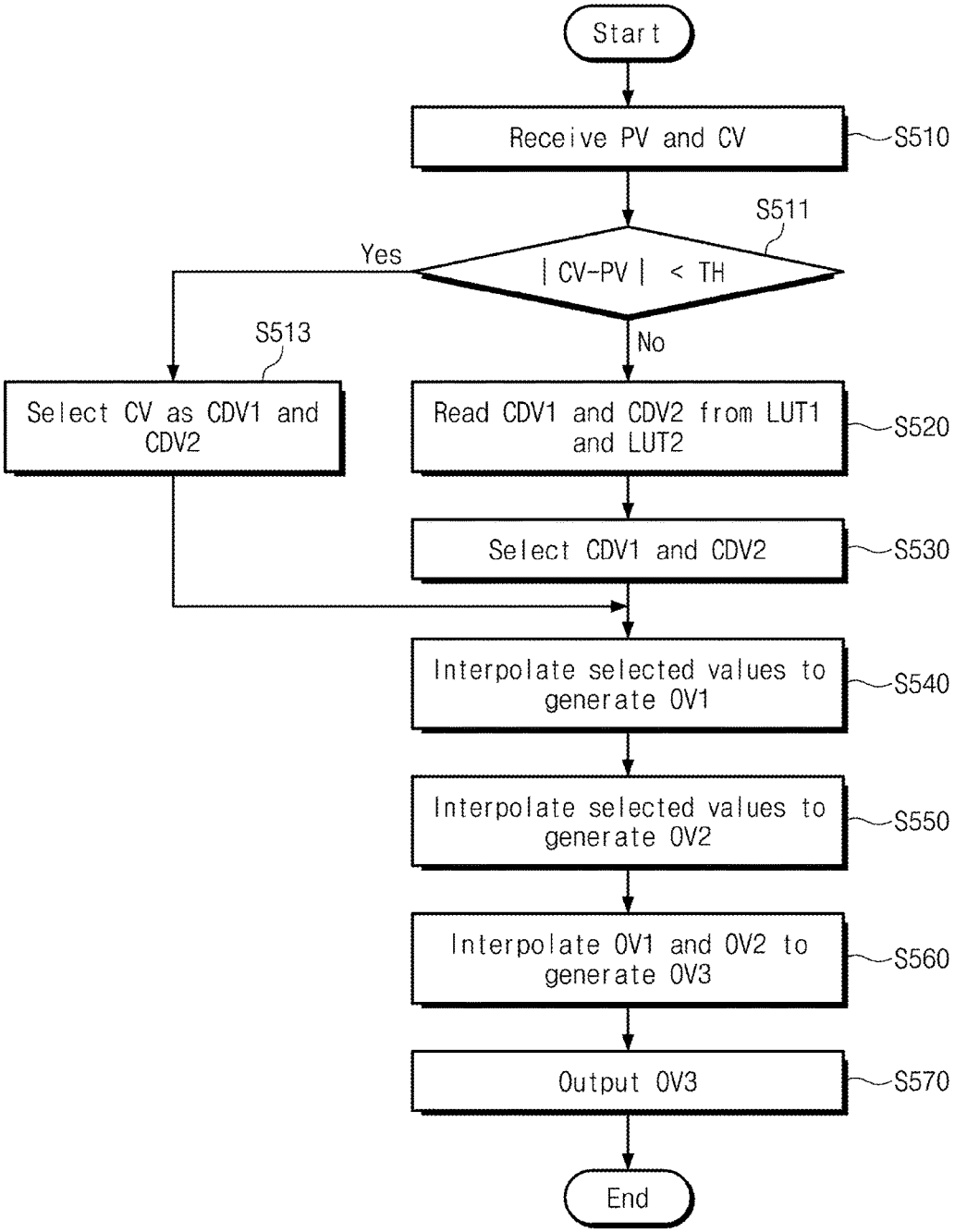
FIG. 15 is a flowchart illustrating an operation method of an overdrive controller of FIG. 14.

FIG. 15 is a flowchart illustrating an operation method of an overdrive controller 141*c* of FIG. 14. Referring to FIGS. 1, 14, and 15, in operation S510, the overdrive controller 141*c* may receive a previous value PV and a current value CV. In operation S511, the overdrive controller 141*c* may detect any change between the previous value PV and the current value CV.

Operation S511 may be performed in the same manner as operation S431. If no change between the previous value PV and the current value CV is detected, the overdrive controller 141*c* may select the current value CV as first and second candidate overdrive values CDV1 and CDV2. For example, in response to a selection signal SEL, a multiplexer 147_2 may select the current value CV.

If no change between the previous value PV and the current value CV is not detected, in operation S520, the overdrive controller 141*c* may read the first and second candidate overdrive values CDV1 and CDV2 from first and second LUTs LUT1 and LUT2 of a memory 142. In operation S530, the multiplexer 147_2 may select the first and second candidate overdrive values CDV1 and CDV2 in response to the selection signal SEL.

Operations S540 to S570 may be performed in the same manner as operations S440 to S470. Thus, a detailed description for operations S540 to S570 will be omitted. As an example, operations S510 to S570 may be performed for each of pixels of a selected row. In other words, each of overdrive values for the pixels of the selected row may be calculated individually. The overdrive values of the pixels of the selected row may be calculated in parallel or sequentially.

Figure 16:
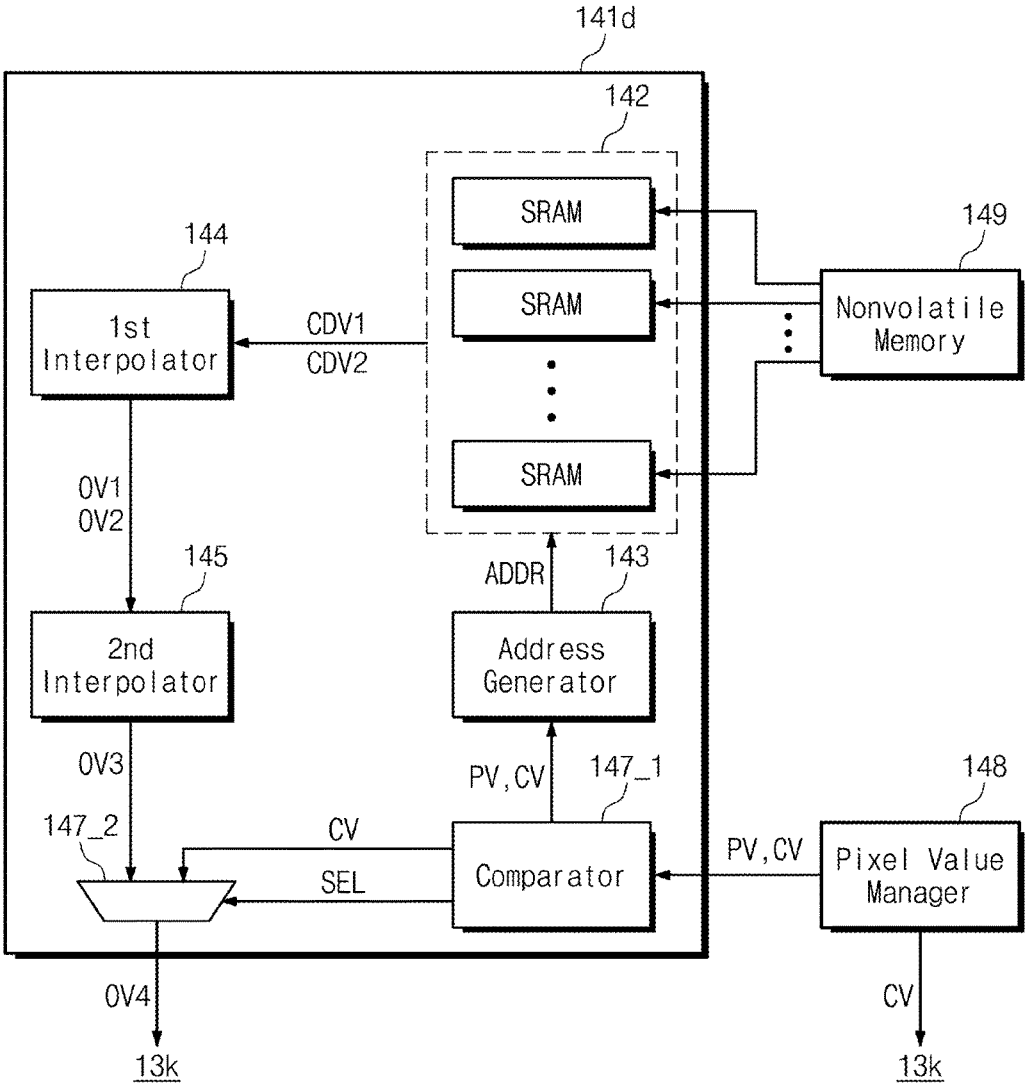
FIG. 16 is a block diagram illustrating an application example of an overdrive controller of FIG. 14.

FIG. 16 is a block diagram illustrating an application example of an overdrive controller 141*c* of FIG. 14. Referring to FIGS. 1 and 16, an overdrive controller 141*d* may include a memory 142, an address generator 143, a first interpolator 144, a second interpolator 145, a comparator 147_1, and a multiplexer 147_2.

The memory 142, the address generator 143, the first interpolator 144, and the second interpolator 145 may operate in the same manner as being described with reference to FIG. 5. The comparator 147_1 may operate in the same manner as being described with reference to FIG. 14. Thus, a detailed description for the memory 142, the address generator 143, the first interpolator 144, the second interpolator 145, and the comparator 147_1 will be omitted.

The multiplexer 147_2 may select a third overdrive value OV3 transmitted from a second interpolator 145 or a current value CV transmitted from the comparator 147_1, depending on a selection signal SEL. The multiplexer 147_2 may output a selected value as a final overdrive value.

When there is a change between a previous value PV and a current value CV, the address generator 143, the memory 142, the first interpolator 144, and the second interpolator 145 may generate the third overdrive value OV3 in the same manner as being described with reference to FIG. 5. The multiplexer 147_2 may output the third overdrive value OV3 as a final overdrive value.

When there is no change between the previous value PV and the current value CV, the address generator 143, the memory 142, the first interpolator 144, and the second interpolator 145 may fail to perform an operation for generating an overdrive value. The multiplexer 147_2 may output the current value CV as a final overdrive value. Thus, power consumption of the overdrive controller 141*d*, a timing controller 140, and a display device 100 may be reduced.

As an example embodiment, the configuration of the overdrive controller 141*d* for calculating an overdrive value for one specific pixel is shown in FIG. 16. Overdrive values of pixels of a selected row may be calculated in parallel or sequentially using the same configuration as being shown in FIG. 16.

As an example, as described with reference to FIGS. 7A to 8, the second interpolator 145 may be configured to interpolate first and second overdrive values OV1 and OV2 based on an interpolation line (or a weight line). As described with reference to FIGS. 9A to 9C, intervals of reference pixels SP may be set in a different way according to an amount of a change in luminance. As an example, as described with reference to FIG. 10, the overdrive controller 141*b* may further include a cache memory 146.

Figure 17:
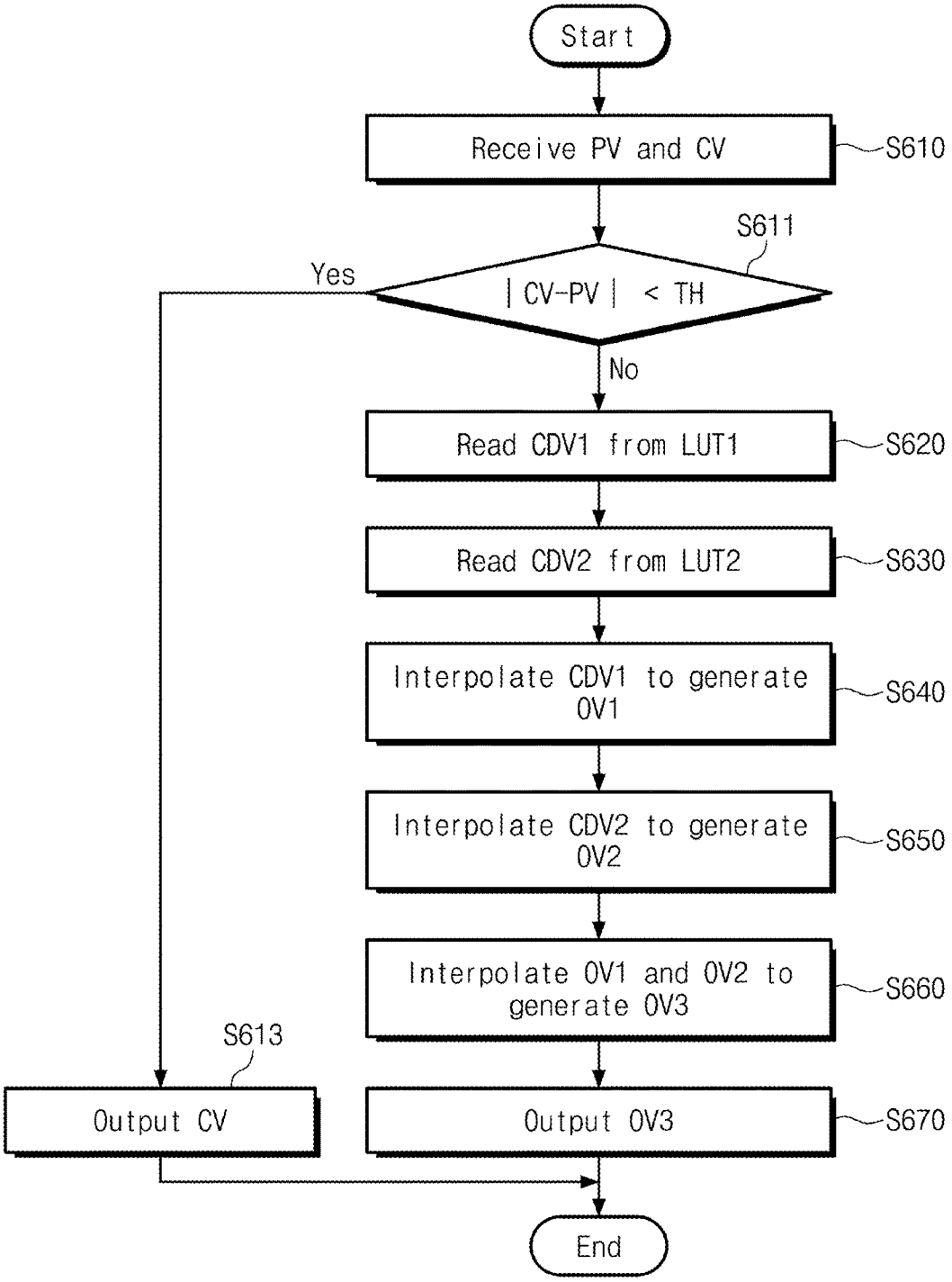
FIG. 17 is a flowchart illustrating an operation method of an overdrive controller of FIG. 16.

FIG. 17 is a flowchart illustrating an operation method of an overdrive controller 141*d* of FIG. 16. Referring to FIGS. 1, 16, and 17, in operation S610, the overdrive controller 141*d* may receive a previous value PV and a current value CV. In operation S611, the overdrive controller 141*d* may detect any change between the previous value PV and the current value CV.

Operation S611 may be performed in the same manner as operation S431 of FIG. 13. When there is no change between the previous value PV and the current value CV, in operation S613, the overdrive controller 141*d* may output the current value CV as a final overdrive value. When a change is detected, operation S620 may be performed.

Operations S620 to S670 may be performed in the same manner as operations S120 to S170 of FIG. 6. Thus, a detailed description for operations S620 to S670 will be omitted. As an example, operations S610 to S670 may be performed for each of pixels of a selected row. In other words, each of overdrive values for the pixels of the selected row may be calculated individually. The overdrive values of the pixels of the selected row may be calculated in parallel or sequentially.

Figure 18:
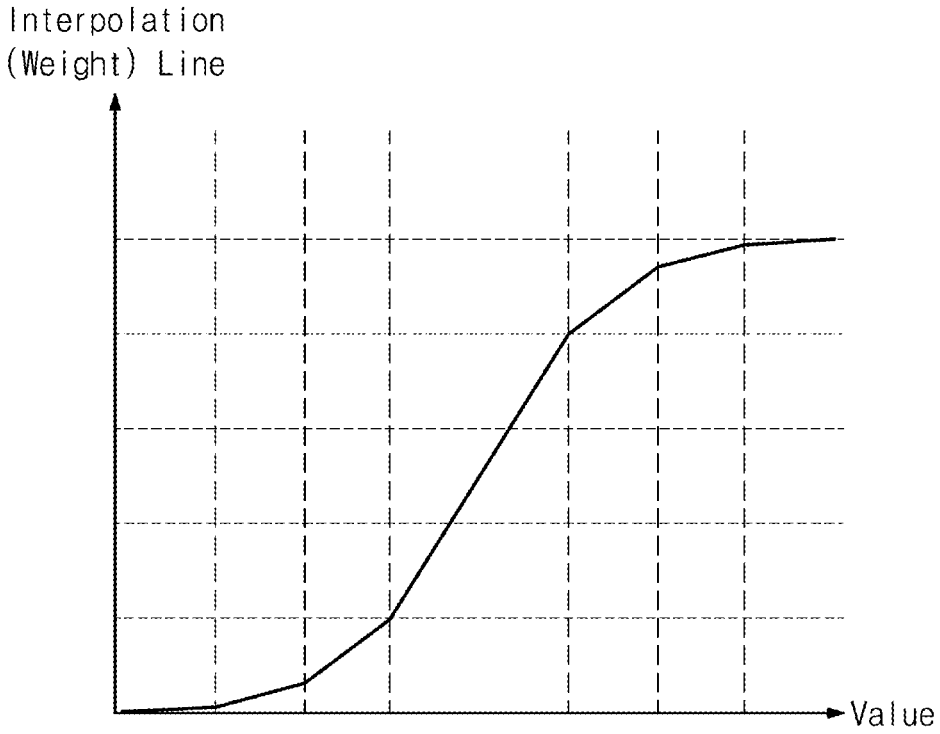
FIG. 18 is a drawing illustrating an example of an interpolation line applied to a first interpolator.

FIG. 18 is a drawing illustrating an example of an interpolation line applied to a first interpolator 144. In FIG. 18, a horizontal axis may represent a previous value PV or a current value CV and a vertical axis may represent a weight value (or a gain) used by the first interpolator 144.

Referring to FIGS. 1, 5, and 18, the first interpolator 144 may calculate a value of an interpolation line (or a weight line) depending on a previous value PV or a current value CV of a specific pixel and may perform interpolation by using the calculated value as a weight value.

In other words, ranges may be specified to previous values PV or current values CV of pixels P. Different interpolation weight values may be applied to each of the ranges. The interpolation weight value may be weighted to a lower previous or current value or a higher previous or current value among values used for interpolation.

For example, a weight value may be applied to coefficients a and b or c and d of Equation 1. While the sum of the coefficients a and b or c and d is kept at 1, values of the coefficients a and b or c and d may be adjusted according to an interpolation line (or a weight line). For example, as a value of an interpolation line (or a weight line) increases more, the values of the coefficients a and b or c and d decrease or increase more and the values of the coefficients a and b or c and d may increase or decrease more.

As shown in FIG. 4, each of a previous value PV and a current value CV may have a minimum value (e.g., 0) and a maximum value (e.g., 255). The previous value PV or the current value CV has the maximum value (e.g., 255), and an overdrive value OV may not be greater than the maximum value. Thus, in values adjacent to the maximum value, a third overdrive value OV3 calculated from an LUT may have distortion.

As described with reference to FIG. 18, when the first interpolator 144 changes a weight value depending on a previous value PV and a current value CV and performs interpolation using the changed weight value, distortion may be prevented from being generated in the third overdrive value OV3 among values adjacent to the maximum value. Thus, an image of an overdrive controller 141, a timing controller 140, and a display device 100 may increase in quality.

Figure 19:
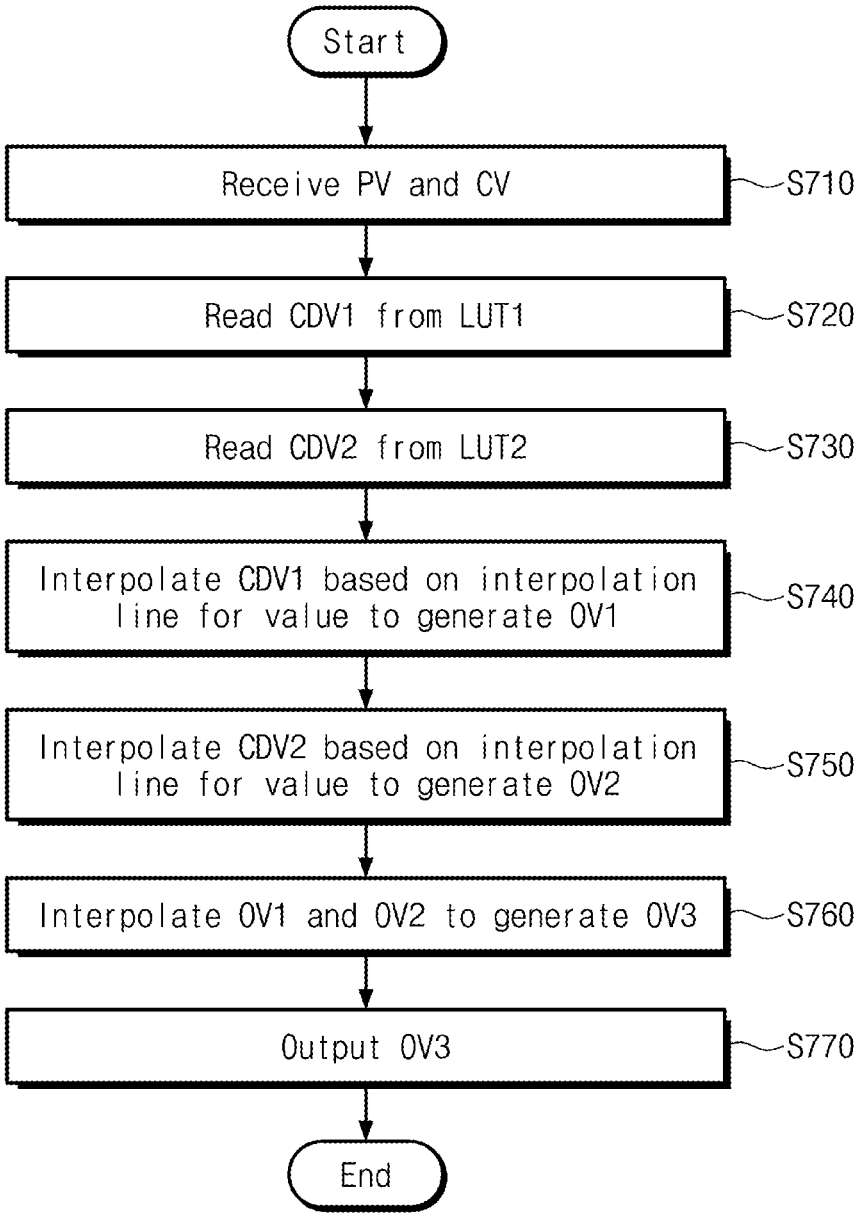
FIG. 19 is a flowchart illustrating an operation method of an overdrive controller using an interpolation line described with reference to FIG. 18.

FIG. 19 is a flowchart illustrating an operation method of an overdrive controller 141 using an interpolation line described with reference to FIG. 18. Referring to FIGS. 1, 5, 18, and 19, operations S710 to S730 may be performed in the same manner as operations S110 to S130. Thus, a detailed description for operations S710 to S730 will be omitted.

In operation S740, the overdrive controller 141 may interpolate first candidate overdrive values CDV1 based on an interpolation line for a previous value PV or a current value CV to generate a first overdrive value OV1.

In operation S750, the overdrive controller 141 may interpolate second candidate overdrive values CDV2 based on the interpolation line for the previous value PV or the current value CV to generate a second overdrive value OV2. Operations S760 and S770 may be performed in the same manner as operations S160 and S170. Thus, a detailed description for operations S760 and S770 will be omitted.

As described above, the overdrive controller 141 described with reference to FIGS. 5 and 6 may adjust a weight value of interpolating overdrive values depending on a position of a specific pixel, as described with reference to FIG. 7A to 9C. Further, as described with reference to FIGS. 10 and 11, the overdrive controller 141 may have a cache memory 146.

As described with reference to FIGS. 12 to 17, when there is no change between a previous value PV and a current value CV, the overdrive controller 141 may output the current value CV as a final overdrive value. As described with reference to FIGS. 18 and 19, the overdrive controller 141 may adjust a weight value of interpolating first or second candidate overdrive values CDV1 or CDV2 depending on a previous value PV or a current value CV.

Thus, an image may be prevented from deteriorating in quality according to a change in luminance of pixels P. Power consumed by access to a memory 142 may be reduced. Distortion by sameness may be prevented. Distortion by a limit of a maximum value of each of a previous value PV and a current value CV may be prevented. Thus, the overdrive controller 141, a timing controller 140, and a display device 100 for providing reduced power consumption and enhanced image quality may be provided.

According to an example embodiment, response of pixels may be enhanced (e.g., response time may be reduced), and an image may increase in quality by reflecting a characteristic according to positions of pixels. According to an example embodiment, response of pixels may be enhanced, and power consumption may be reduced. According to an example embodiment, response of pixels may be enhanced, a distortion of an image, caused by the enhancement of the response, may be prevented.

While novel concepts have been described with reference to example embodiments, it will be apparent to those skilled in the art that various changes and modifications may be made without departing from the spirit and scope of the present disclosure. Therefore, it should be understood that the above example embodiments are not limiting, but illustrative.

What is claimed is:

1. A display device, comprising:

pixels arranged in rows and columns;

gate drivers connected to the rows of the pixels through gate lines;

source drivers connected to the columns of the pixels through source lines; and a timing controller configured to control the gate drivers and the source drivers, wherein the timing controller comprises an overdrive controller configured to:

store look-up tables (LUTs) including candidate overdrive values according to previous values and current values with respect to reference pixels among the pixels;

generate overdrive values associated with a previous value and a current value of a specific pixel from specific LUTs associated with the specific pixel of a selected row among the pixels among the LUTs; and output a final overdrive value of the specific pixel by interpolating the overdrive values, wherein a source driver associated with the specific pixel among the source drivers supplies an overdrive voltage corresponding to the final overdrive value to a source line connected to the specific pixel and supplies a source line voltage corresponding to the current value of the specific pixel to the source line, and wherein the overdrive controller is configured to:

adjust weight values of at least two of the overdrive values based on a position of the specific pixel; and interpolate the at least two of the overdrive values using the weight values.

2. The display device of claim 1, wherein the overdrive controller is further configured to adjust the weight values based on whether the specific pixel belongs to any of the columns of the pixels.

3. The display device of claim 2, wherein the reference pixels have non-uniform intervals where the reference pixels are located in a same row.

4. The display device of claim 1, wherein the overdrive controller is further configured to calculate the overdrive values from the specific LUTs of specific reference pixels which are nearest to the specific pixel and belong to one of a same row and a same column as the specific pixel.

5. The display device of claim 1, wherein the overdrive controller is further configured to:

read specific candidate overdrive values from each of the specific LUTs using the previous value and the current value of the specific pixel; and generate each of the overdrive values by interpolating the specific candidate overdrive values.

6. The display device of claim 1, wherein the specific LUTs comprise a first LUT and a second LUT, and wherein the overdrive controller comprises:

an address generator configured to receive the previous value and the current value of the specific pixel and generate an address based on the previous value and the current value;

a memory configured to store the LUTs, output first candidate overdrive values corresponding to the previous value and the current value in the first LUT based on the address, and output second candidate overdrive values corresponding to the previous value and the current value in the second LUT based on the address;

a first interpolator configured to output a first overdrive value among the overdrive values by interpolating the first candidate overdrive values and output a second overdrive value among the overdrive values by interpolating the second candidate overdrive values; and a second interpolator configured to output the final overdrive value by interpolating the first overdrive value and the second overdrive value.

7. The display device of claim 6, wherein the overdrive controller further comprises:

a cache memory configured to receive the address, output one of the first candidate overdrive values and the second candidate overdrive values in response to one of the first candidate overdrive values and the second candidate overdrive values corresponding to the address being stored, and transmit the address to the memory in response to one of the first candidate overdrive values and the second candidate overdrive values corresponding to the address being not stored.

8. The display device of claim 7, wherein the memory is further configured to output one of the first candidate overdrive values and the second candidate overdrive values to the cache memory based on the address transmitted from the cache memory, and wherein the cache memory is further configured to store and output one of the first candidate overdrive values and the second candidate overdrive values.

9. The display device of claim 1, wherein the overdrive controller is further configured to select the current value as the final overdrive value in response to a difference between the previous value and the current value of the specific pixel being less than a threshold value.

10. The display device of claim 1, wherein the overdrive controller is further configured to:

read specific candidate overdrive values from each of the specific LUTs using the previous value and the current value of the specific pixel;

adjust candidate overdrive weight values of the specific candidate overdrive values based on ranges of one of the previous value and the current value; and generate each of the overdrive values by interpolating the specific candidate overdrive values.

11. The display device of claim 10, wherein the ranges of one of the previous value and the current value have different sizes.

12. A display device, comprising:

pixels arranged in rows and columns;

gate drivers connected to the rows of the pixels through gate lines;

source drivers connected to the columns of the pixels through source lines; and a timing controller configured to control the gate drivers and the source drivers, wherein the timing controller comprises:

an address generator configured to receive a previous value and a current value of a specific pixel and generate an address based on the previous value and the current value;

a cache memory configured to receive the address, output one of first candidate overdrive values and second candidate overdrive values in response to one of the first candidate overdrive values and the second candidate overdrive values corresponding to the address being stored, and output the address in response to one of the first candidate overdrive values and the second candidate overdrive values being not stored;

a memory configured to store look-up tables (LUTs) and transmit one of the first candidate overdrive values and the second candidate overdrive values associated with the address from the LUTs to the cache memory in response to the address being received from the cache memory;

a first interpolator configured to output a first overdrive value by interpolating the first candidate overdrive values and output a second overdrive value by interpolating the second candidate overdrive values; and a second interpolator configured to output a final overdrive value by interpolating the first overdrive value and the second overdrive value, and wherein each of the source drivers supplies an overdrive voltage corresponding to the final overdrive value to a source line connected to the specific pixel and supplies a source line voltage corresponding to the current value of the specific pixel to the source line.

13. The display device of claim 12, wherein the timing controller is configured to select the current value as the final overdrive value in response to a difference between the previous value and the current value of the specific pixel being less than a threshold value.

14. The display device of claim 12, wherein the timing controller is configured to:

adjust first weight values of the first candidate overdrive values depending on a range to which one of the previous value and the current value belongs;

generate the first overdrive value by interpolating the first candidate overdrive values;

adjust second weight values of the second candidate overdrive values depending on the range to which one of the previous value and the current value belongs; and generate the second overdrive value by interpolating the second candidate overdrive values.

15. A display device, comprising:

pixels arranged in rows and columns;

gate drivers connected to the rows of the pixels through gate lines;

source drivers connected to the columns of the pixels through source lines; and a timing controller configured to control the gate drivers and the source drivers, wherein the timing controller comprises an overdrive controller configured to:

store look-up tables (LUTs) including candidate overdrive values according to previous values and current values with respect to reference pixels among the pixels;

generate overdrive values associated with a previous value and a current value of a specific pixel from specific LUTs associated with the specific pixel of a selected row among the pixels among the LUTs; and output a final overdrive value of the specific pixel by interpolating the overdrive values, wherein a source driver associated with the specific pixel among the source drivers supplies an overdrive voltage corresponding to the final overdrive value to a source line connected to the specific pixel and supplies a source line voltage corresponding to the current value of the specific pixel to the source line, and wherein the overdrive controller is further configured to select the current value as the final overdrive value in response to a difference between the previous value and the current value of the specific pixel being less than a threshold value.

16. The display device of claim 15, wherein the overdrive controller comprises:

an address generator configured to receive the previous value and the current value of the specific pixel and generate an address based on the previous value and the current value;

a memory configured to store the LUTs, output first candidate overdrive values and second candidate overdrive values corresponding to the address from the LUTs;

a first interpolator configured to output a first overdrive value by interpolating the first candidate overdrive values and output a second overdrive value by interpolating the second candidate overdrive values; and a second interpolator configured to output the final overdrive value by interpolating the first overdrive value and the second overdrive value.

17. The display device of claim 16, wherein the overdrive controller further comprises:

a comparator configured to receive the previous value and the current value, output the current value, and activate a selection signal in response to the difference between the previous value and the current value being less than the threshold value; and a multiplexer configured to receive the first candidate overdrive values and the second candidate overdrive values from the memory, transmit the first candidate overdrive values and the second candidate overdrive values to the first interpolator in response to the selection signal being deactivated, and transmit the current value to the first interpolator in response to the selection signal being activated.

18. The display device of claim 16, wherein the overdrive controller further comprises:

a comparator configured to receive the previous value and the current value, output the current value, activate a selection signal in response to the difference between the previous value and the current value being less than the threshold value, and output the previous value and the current value to the address generator in response to the difference between the previous value and the current value being greater than the threshold value; and a multiplexer configured to receive the first candidate overdrive values and the second candidate overdrive values from the memory, transmit the first candidate overdrive values and the second candidate overdrive values to the first interpolator in response to the selection signal being deactivated, and transmit the current value to the first interpolator in response to the selection signal being activated.

19. The display device of claim 16, wherein the overdrive controller further comprises:

a comparator configured to receive the previous value and the current value, output the current value, activate a selection signal in response to the difference between the previous value and the current value being less than the threshold value, and output the previous value and the current value to the address generator in response to the difference between the previous value and the current value being greater than the threshold value; and a multiplexer configured to output an output of the second interpolator as the final overdrive value in response to the selection signal being deactivated and output the current value as the final overdrive value in response to the selection signal being activated.

20. The display device of claim 15, wherein the overdrive controller is further configured to:

read candidate overdrive values from one of the specific LUTs using the previous value and the current value of the specific pixel;

adjust weight values of the candidate overdrive values depending on a range to which one of the previous value and the current value belongs; and generate one of the overdrive values by interpolating the candidate overdrive values.

* * * * *